US010722782B2

(12) United States Patent
Hung et al.

(10) Patent No.: US 10,722,782 B2
(45) Date of Patent: Jul. 28, 2020

(54) RHOMBIC DODECAHEDRON PUZZLE AND MULTIPLE RHOMBIC DODECAHEDRON PUZZLE

(71) Applicant: NATIONAL TSING HUA UNIVERSITY, Hsinchu (TW)

(72) Inventors: Wen-Liang Hung, Hsinchu (TW); Ku-Yu Fan, New Taipei (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 0 days.

(21) Appl. No.: 16/149,117

(22) Filed: Oct. 1, 2018

(65) Prior Publication Data

US 2019/0374850 A1 Dec. 12, 2019

(30) Foreign Application Priority Data

Jun. 7, 2018 (TW) ..... 107207645 U

(51) Int. Cl.
*A63F 9/12* (2006.01)

(52) U.S. Cl.
CPC .... *A63F 9/1208* (2013.01); *A63F 2009/1244* (2013.01)

(58) Field of Classification Search
CPC .. A63F 9/1208; A63F 2009/1244; A63F 9/06; A63F 9/0602; A63F 9/088; A63F 9/1204; A63F 2009/1236; G09B 23/04
See application file for complete search history.

(56) References Cited

U.S. PATENT DOCUMENTS 3,645,535 A * 2/1972 Randolph ..... A63F 9/12 273/157 R
4,009,882 A * 3/1977 Rader ..... A63F 9/0098 273/240
4,142,321 A * 3/1979 Coppa ..... A63H 33/16 273/155
4,258,479 A * 3/1981 Roane ..... A63H 33/046 434/211
4,317,653 A * 3/1982 Wahl ..... G09B 23/04 434/211
4,317,654 A * 3/1982 Wahl ..... G09B 23/04 434/211
4,334,870 A * 6/1982 Roane ..... A63H 33/046 434/211
4,334,871 A * 6/1982 Roane ..... A63H 33/046 434/211
5,249,966 A * 10/1993 Hiigli ..... G09B 23/04 434/211

(Continued)

*Primary Examiner* — Steven B Wong
(74) *Attorney, Agent, or Firm* — CKC & Partners Co., LLC

(57) ABSTRACT

A multiple rhombic dodecahedron puzzle includes a plurality of wooden puzzles arranged in a multiple rhombic dodecahedron. The multiple rhombic dodecahedron is equivalent to a cube formed by a plurality of rhombic dodecahedrons connecting to each other. Each of the wooden puzzles includes two unit elements. The two unit elements are connected to each other and are the same others. Each of the two unit elements has a plurality of surfaces. Each of the surfaces has a diamond shape or a triangular shape. Two of the surfaces which in the triangular shape are connected to each other in order to form a concave shape, and the surfaces are surrounded to form a closed space.

6 Claims, 36 Drawing Sheets

(56) References Cited

U.S. PATENT DOCUMENTS

| | | | | |
|---|---|---|---|---|
| 6,257,574 | B1 * | 7/2001 | Evans | A63F 9/12 273/157 R |
| 6,264,199 | B1 * | 7/2001 | Schaedel | A63F 9/088 273/155 |
| 9,980,591 | B2 * | 5/2018 | Villano | A47G 27/0218 |
| 2002/0058456 | A1 * | 5/2002 | Miller | A63H 33/084 446/85 |
| 2006/0097448 | A1 * | 5/2006 | Kinberg | A63F 9/10 273/157 R |
| 2009/0014954 | A1 * | 1/2009 | Cook | A63F 9/1204 273/157 R |

* cited by examiner

400

400

400

400

400

400

400

400

400

400

400

400

400

400

400

400

400

400

400

400

400

400

400

400

400

400

400

400

400

400

400

400

400

400

400

400

400

400

500

600

700a

700b

800a

800b

900a

900b

RHOMBIC DODECAHEDRON PUZZLE AND MULTIPLE RHOMBIC DODECAHEDRON PUZZLE

RELATED APPLICATIONS

This application claims priority to Taiwan Application Serial Number 107207645, filed Jun. 7, 2018, which is herein incorporated by reference.

BACKGROUND

Technical Field

The present disclosure relates to a puzzle. More particularly, the present disclosure relates to a rhombic dodecahedron puzzle and a multiple rhombic dodecahedron puzzle.

Description of Related Art

Wooden puzzles can enhance understanding of geometric shapes, develop a spatial awareness and train a player in manipulation and logical thinking. In addition, the wooden puzzles can cultivate the abilities of spatial rotation and mental rotation, so that the wooden puzzles are appropriate for all ages to increase the concentration. As for children, the wooden puzzles may be used to train thinking to improve the abilities of math and logic.

In conventional wooden puzzles, there are patterns on the surfaces of the conventional wooden puzzles. A difficulty level of the conventional wooden puzzles often depends on the number of puzzle pieces and the complexity of the patterns. The conventional wooden puzzles include a unit element which has a square shape, a triangular shape or a spherical shape, such as an eighteen-piece pro-tang ram tiling puzzles, a multi-cube puzzle, etc. The conventional wooden puzzles can be joined according the patterns on the surfaces. However, a joining method of the conventional wooden puzzles has only one solution and is too monotonous. If the number of puzzle pieces is too large or the complexity of the patterns is too high, it is too difficult to be suitable for junior players.

Therefore, a wooden puzzle which is appropriate for all ages and is capable of cultivating the abilities of spatial rotation and mental rotation, enhancing the problem-solving strategies in geometry and achieving special aesthetic effects are commercially desirable.

SUMMARY

According to one aspect of the present disclosure, a rhombic dodecahedron puzzle includes a plurality of wooden puzzles arranged in a rhombic dodecahedron. Each of the wooden puzzles includes two unit elements. The two unit elements are connected to each other and are the same as each other. Each of the two unit elements has a plurality of surfaces. Each of the surfaces has a diamond shape or a triangular shape. Two of the surfaces having the triangular shape are connected to each other to form a concave shape, and the surfaces are surrounded to form a closed space.

According to another aspect of the present disclosure, a multiple rhombic dodecahedron puzzle includes a plurality of wooden puzzles arranged in a multiple rhombic dodecahedron. The multiple rhombic dodecahedron is equivalent to a cube formed by connecting a plurality of rhombic dodecahedrons to each other. Each of the wooden puzzles includes two unit elements. The two unit elements are connected to each other and are the same as each other. Each of the two unit elements has a plurality of surfaces. Each of the surfaces has a diamond shape or a triangular shape. Two of the surfaces which in the triangular shape are connected to each other to form a concave shape, and the surfaces are surrounded to form a closed space.

BRIEF DESCRIPTION OF THE DRAWINGS

The present disclosure can be more fully understood by reading the following detailed description of the embodiment, with reference made to the accompanying drawings as follows.

DETAILED DESCRIPTION

Before describing any embodiments in detail, some terms used in the following are described. A rhombic dodecahedron represents a cube (i.e., a three-dimensional structure) formed by connecting twelve diamond surfaces to each other. A length ratio of two diagonals and one side of each of the twelve Diamond surfaces is $2\sqrt{2}:2:\sqrt{3}$. A multiple rhombic dodecahedron represents a cube formed by completely coinciding surfaces of a plurality of rhombic dodecahedrons with each other. For example, a two-rhombic dodecahedron represents a cube formed by completely coinciding two surfaces of two rhombic dodecahedrons with each other. A three-rhombic dodecahedron represents a cube formed by completely coinciding surfaces of three rhombic dodecahedrons with each other. A four-rhombic dodecahedron represents a cube formed by completely coinciding surfaces of four rhombic dodecahedrons with each other. A five-rhombic dodecahedron represents a cube formed by completely coinciding surfaces of five rhombic dodecahedrons with each other. A six-rhombic dodecahedron represents a cube formed by completely coinciding surfaces of six rhombic dodecahedrons with each other.

Figure 1A:
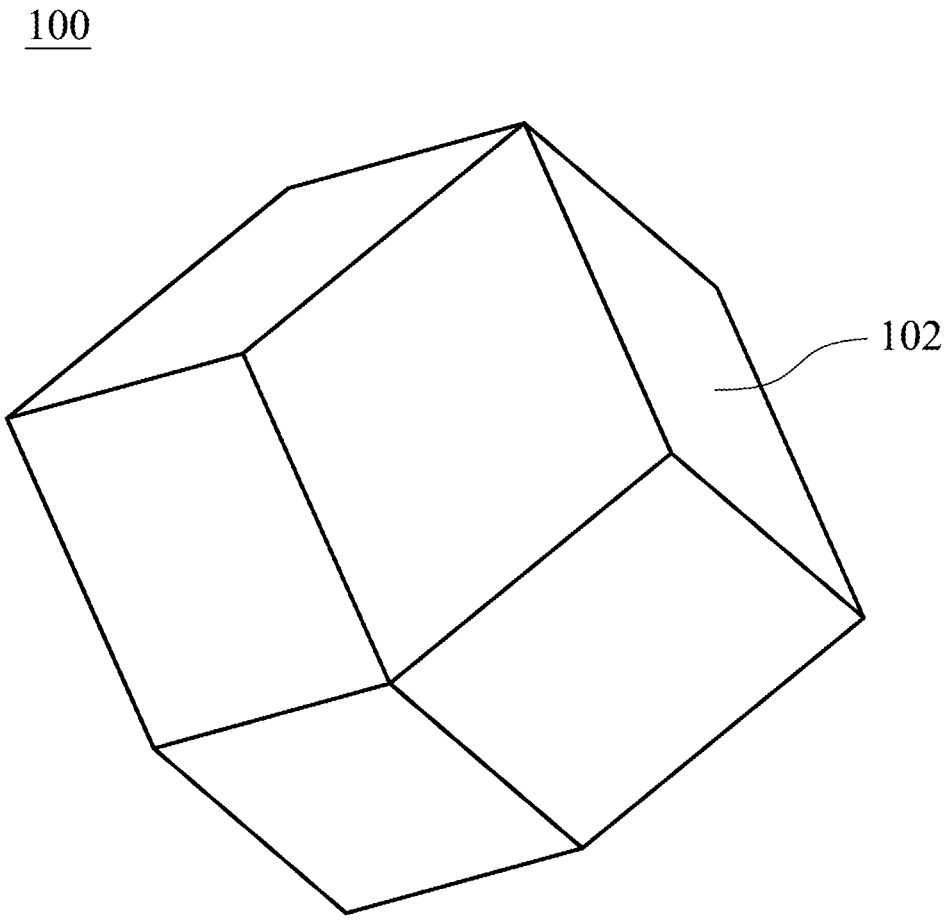
FIG. 1A shows a schematic view of a rhombic dodecahedron puzzle according to one embodiment of the present disclosure.
Figure 1B:
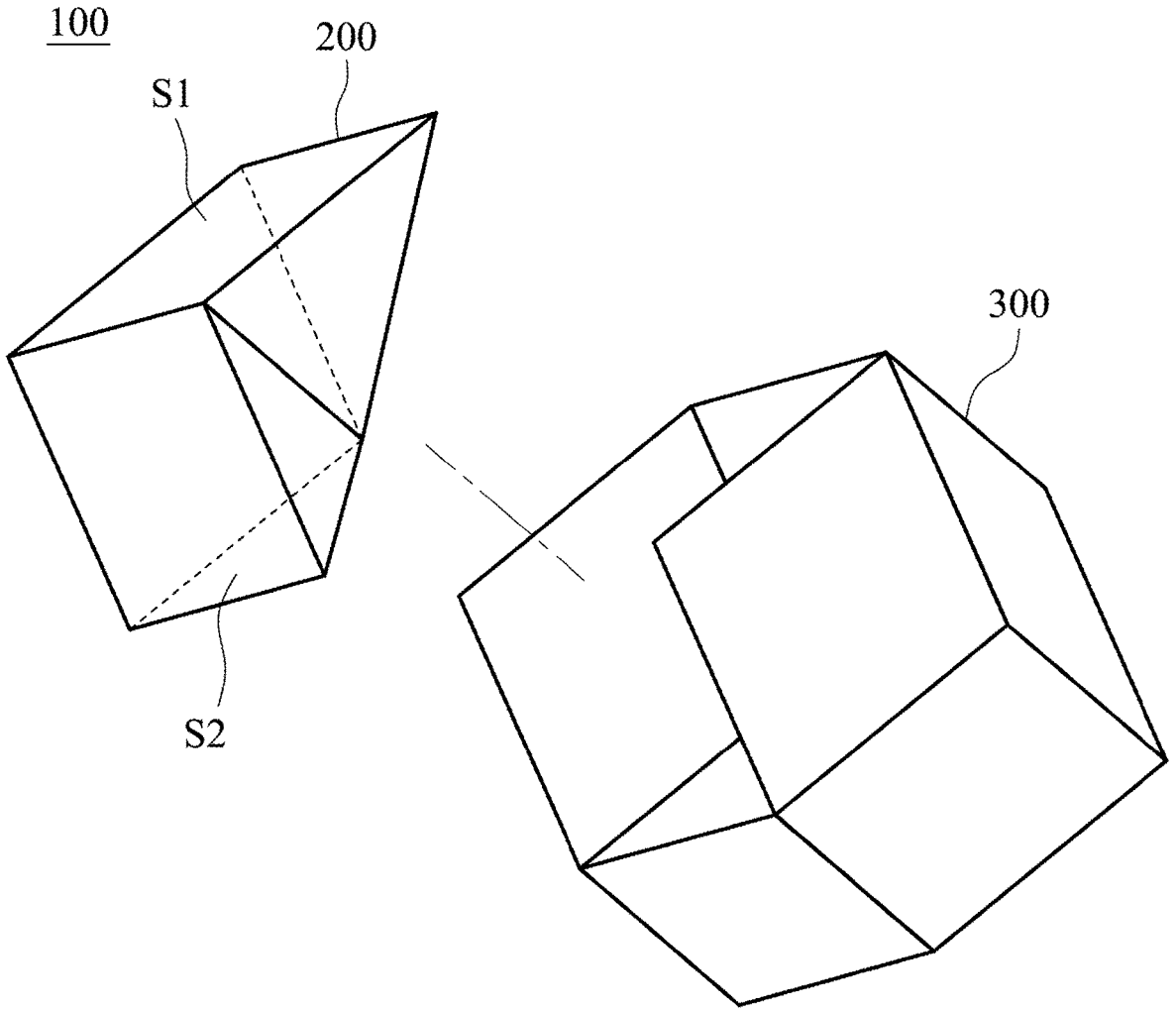
FIG. 1B shows an exploded view of the rhombic dodecahedron puzzle of FIG. 1A.
Figure 1C:
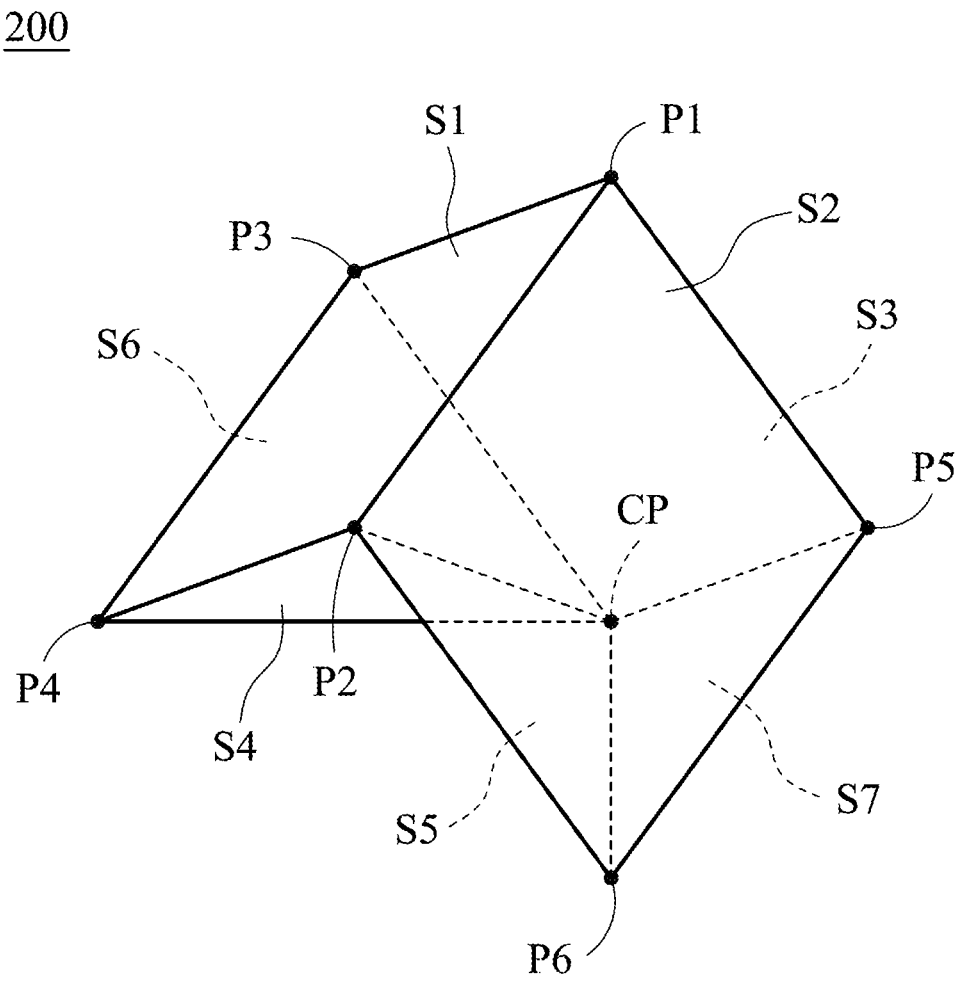
FIG. 1C shows a schematic view of a unit element of the rhombic dodecahedron puzzle of FIG. 1B.

FIG. 1A shows a schematic view of a rhombic dodecahedron puzzle 100 according to one embodiment of the present disclosure; FIG. 1B shows an exploded view of the rhombic dodecahedron puzzle 100 of FIG. 1A; and FIG. 1C shows a schematic view of a unit element 200 of the rhombic dodecahedron puzzle 100 of FIG. 1B. A rhombic dodecahedron puzzle 100 represents a cube formed by connecting twelve diamond surfaces 102 to each other. The twelve diamond surfaces 102 are equivalent to each other. A rhombic dodecahedron puzzle 100 includes the unit element 200 and an additional element 300. The additional element 300 includes five unit elements 200, so that the rhombic dodecahedron puzzle 100 includes six unit elements 200. Each of the unit elements 200 has a plurality of surfaces, and each of the surfaces has a diamond shape or a triangular shape. Two of the surfaces having the triangular shape are connected to each other to form a concave shape, and the surfaces are surrounded to form a closed space. In detail, the unit element 200 has a concave body. The surfaces of the unit element 200 includes a first surface S1, a second surface S2, a third surface S3, a fourth surface S4, a fifth surface S5, a sixth surface S6 and a seventh surface S7. The first surface S1, the second surface S2 and the third surface S3 are connected to each other. The fourth surface S4 and the fifth surface S5 are connected to each other to form the concave shape. The fourth surface S4 and the fifth surface S5 are connected to the first surface S1 and the second surface S2, respectively. The sixth surface S6 is connected to the first surface S1, the third surface S3 and the fourth surface S4. The seventh surface S7 is connected to the second surface S2, the third surface S3 and the fifth surface S5. Each of the first surface S1, the second surface S2 and the third surface S3 has the diamond shape. Each of the fourth surface 84, the fifth surface S5, the sixth surface S6 and the seventh surface S7 has the triangular shape. In addition, each of the two unit elements has a first vertex P1, a second vertex P2, a third vertex P3, a fourth vertex P4, a fifth vertex P5, a sixth vertex P6 and a central vertex CP. The central vertex CP is a central point of the rhombic dodecahedron. In other words, the central vertex CP is a central point of the rhombic dodecahedron puzzle 100. The first vertex P1, the second vertex P2, the third vertex P3 and the fourth vertex P4 are corresponding to the first surface S1. The first vertex P1, the second vertex P2, the fifth vertex P5 and the sixth vertex P6 are corresponding to the second surface S2. The first vertex P1, the third vertex P3, the fifth vertex P5 and the central vertex CP are corresponding to the third surface S3. The second vertex P2, the fourth vertex P4 and the central vertex CP are corresponding to the fourth surface S4. The second vertex P2, the sixth vertex P6 and the central vertex CP are corresponding to the fifth surface S5. The third vertex P3, the fourth vertex P4 and the central vertex CP are corresponding to the sixth surface S6. The fifth vertex P5, the sixth vertex P6 and the central vertex CP are corresponding to the seventh surface S7.

A volume of each of the unit elements 200 is equal to one-sixth of a volume of the rhombic dodecahedron. Each of the first surfaces S1 has a first surface area. Each of the second surfaces S2 has a second surface area. Each of the third surfaces S3 has a third surface area. Each of the fourth surfaces S4 has a fourth surface area. Each of the fifth surfaces S5 has a fifth surface area. Each of the sixth surfaces S6 has a sixth surface area, and each of the seventh surfaces S7 has a seventh surface area. Each of the fourth surface area, the fifth surface area, the sixth surface area and the seventh surface area is one-half of the first surface area. In other words, each of the fourth surface area, the fifth surface area, the sixth surface area and the seventh surface area is equal to an area of each of two triangular surfaces which are formed by dividing the first surface S1 along a diagonal line. The first surface area, the second surface area and the third surface area are equal to each other. The unit element 200 is formed by first selecting two adjacent surfaces of the rhombic dodecahedron, i.e., the first surface S1 and the second surface S2. The first surface S1 and the second surface S2 has the diamond shape and are configured to form a folding surface having six vertices (i.e., the first vertex P1, the second vertex P2, the third vertex P3, the fourth vertex P4, the fifth vertex P5 and the sixth vertex P6). Then, two adjacent vertices of the six vertices and the central vertex CP form a triangle, so that there are six triangles formed by the six vertices and the central vertex CP (i.e., the third surface S3 having two of the six triangles, the fourth surface S4, the fifth surface S5, the sixth surface S6 and the seventh surface S7). Finally, the unit element 200 is formed by the six triangles and the folding surface. In order to clearly describe the structure of the unit element 200, the six vertices and the central vertex CP of the unit element 200 are set in a coordinate system. Three-dimensional coordinates of the central vertex CP, the first vertex P1, the second vertex P2, the third vertex P3, the fourth vertex P4, the fifth vertex P5 and the sixth vertex P6 are (0, 0, 0), (0, 0, 2), (1, 1, 1), (1, −1, 1), (2, 0, 0), (−1, 1, 1) and (0, 2, 0), respectively. Therefore, the rhombic dodecahedron puzzle 100 of the present disclosure utilizes plural unit elements 200 having the concave bodies to form a complete rhombic dodecahedron. The unit element of the present disclosure is different from the unit element of a conventional puzzle.

Figure 1D:
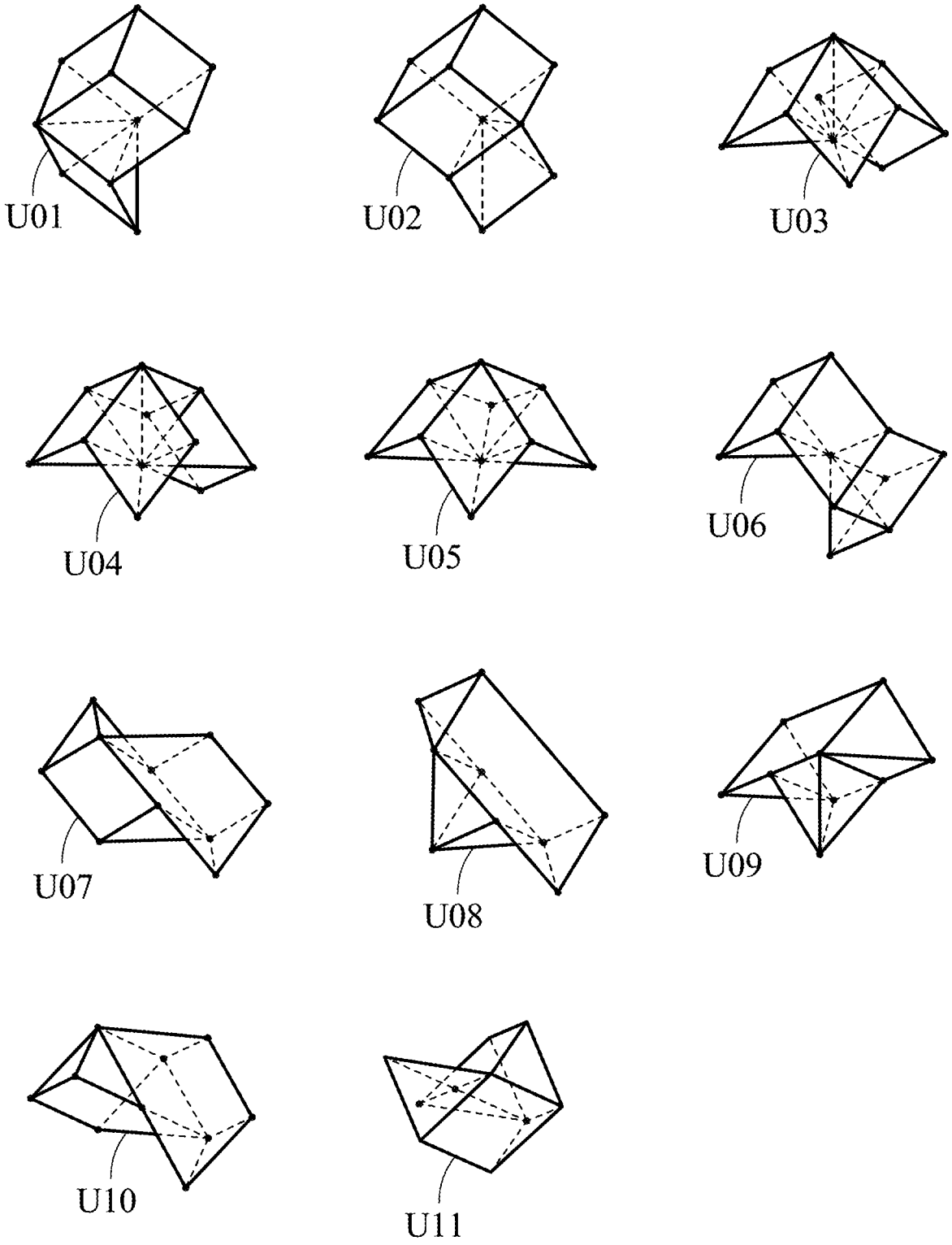
FIG. 1D shows a schematic view of 11 types of wooden puzzles formed by two unit elements of FIG. 1C.
Figure 2A:
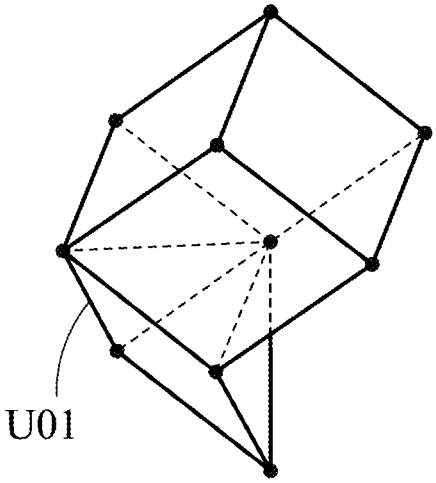
FIG. 2A shows a three-dimensional schematic view of a first wooden puzzle of FIG. 1D.
Figure 2B:
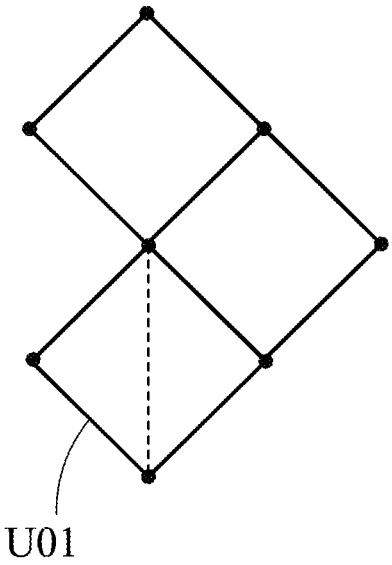
FIGS. 2B, 2C and 2D show three-view drawings of the first wooden puzzle of FIG. 1D, respectively.
Figure 2C:
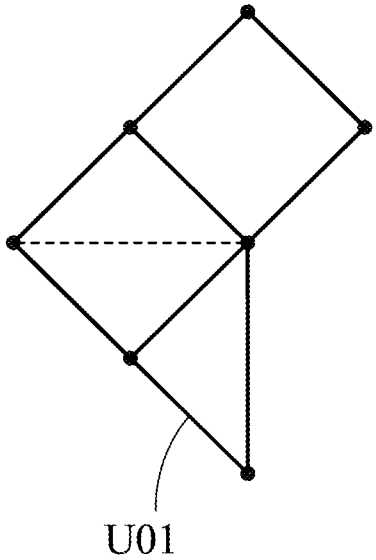
Figure 2D:
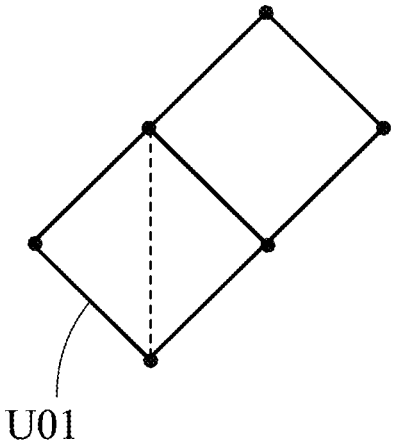
Figure 3A:
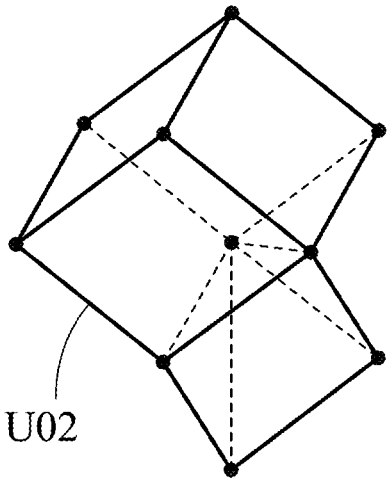
FIG. 3A shows a three-dimensional schematic view of a second wooden puzzle of FIG. 1D.
Figure 3B:
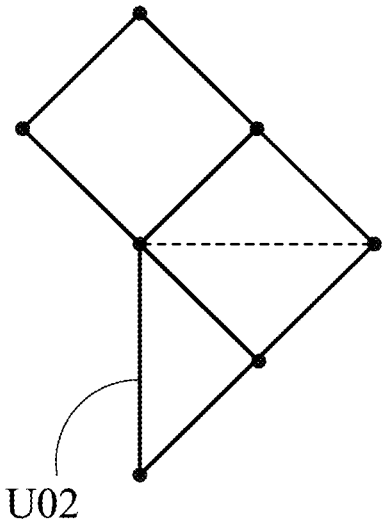
FIGS. 3B, 3C and 3D show three-view drawings of the second wooden puzzle of FIG. 1D, respectively.
Figure 3C:
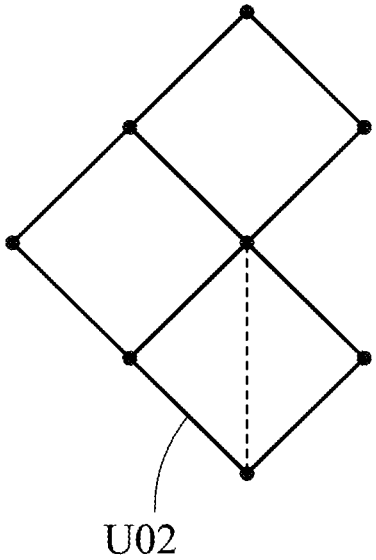
Figure 3D:
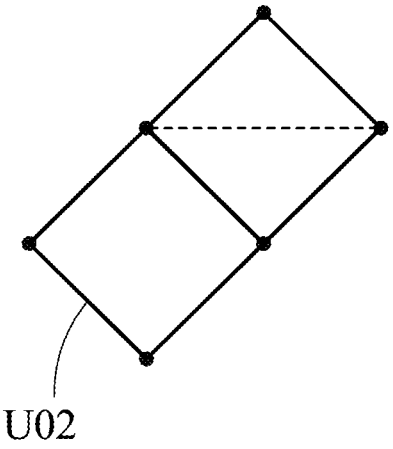
Figure 4A:
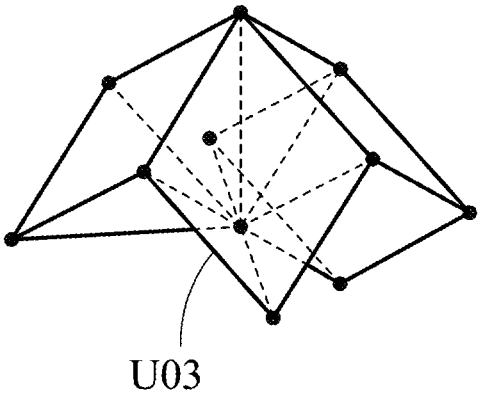
FIG. 4A shows a three-dimensional schematic view of a third wooden puzzle of FIG. 1D.
Figure 4B:
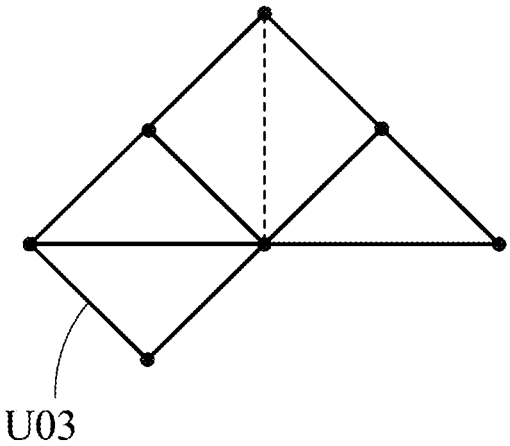
FIGS. 4B, 4C and 4D show three-view drawings of the third wooden puzzle of FIG. 1D, respectively.
Figure 4C:
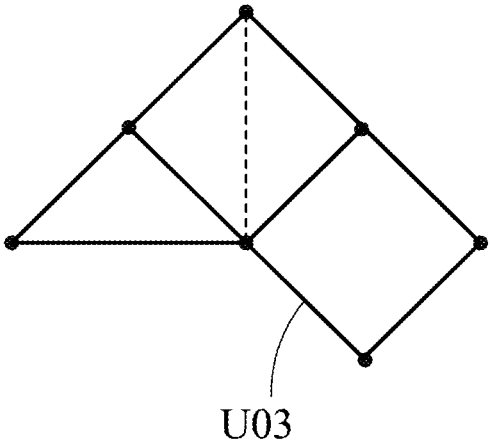
Figure 4D:
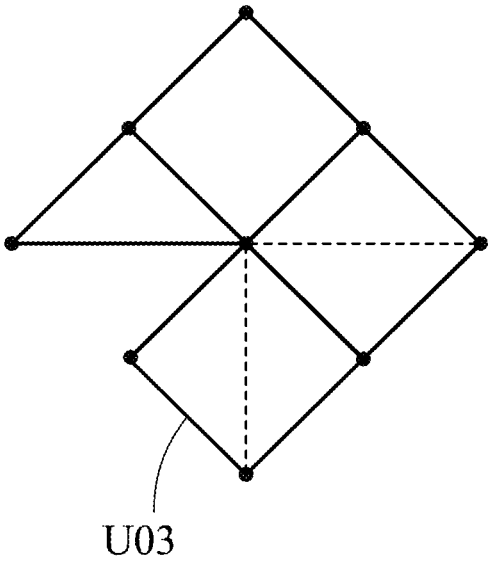
Figure 5A:
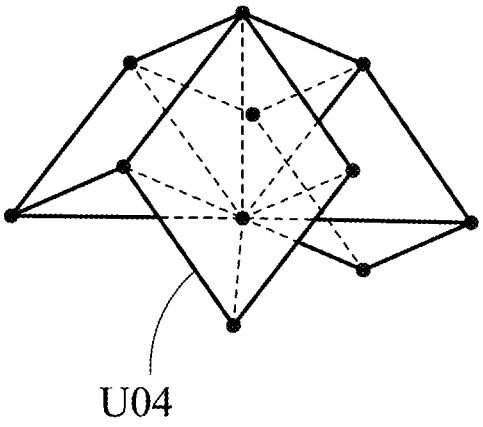
FIG. 5A shows a three-dimensional schematic view of a fourth wooden puzzle of FIG. 1D.
Figure 5B:
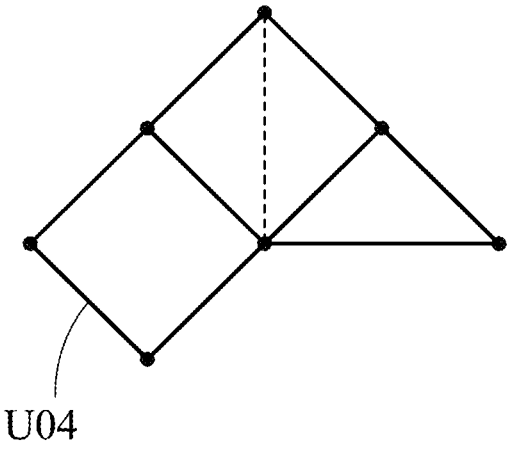
FIGS. 5B, 5C and 5D show three-view drawings of the fourth wooden puzzle of FIG. 1D, respectively.
Figure 5C:
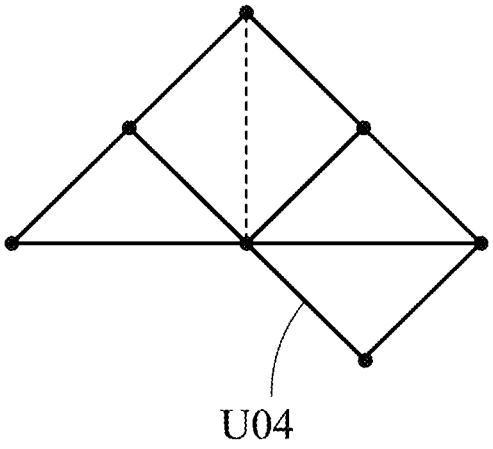
Figure 5D:
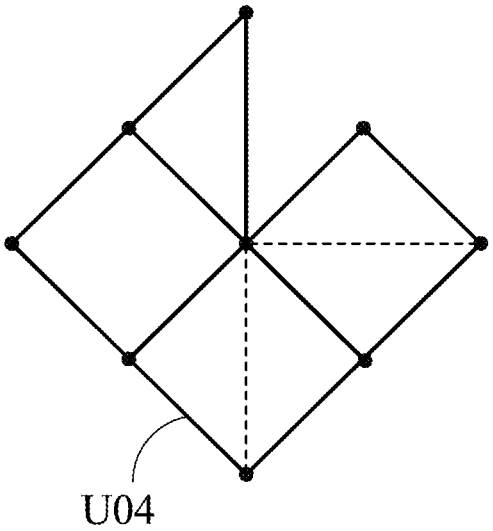
Figure 6A:
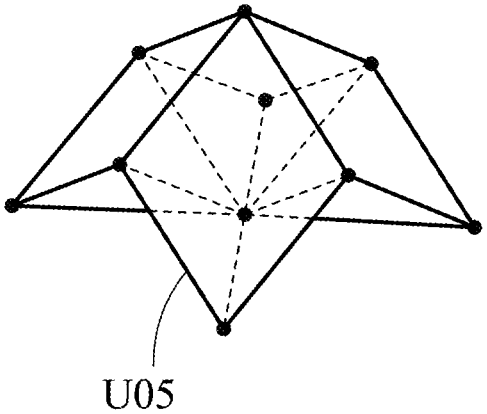
FIG. 6A shows a three-dimensional schematic view of a fifth wooden puzzle of FIG. 1D.
Figure 6B:
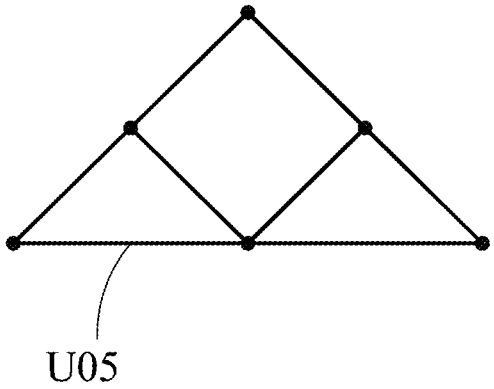
FIGS. 6B, 6C and 6D show three-view drawings of the fifth wooden puzzle of FIG. 1D, respectively.
Figure 6C:
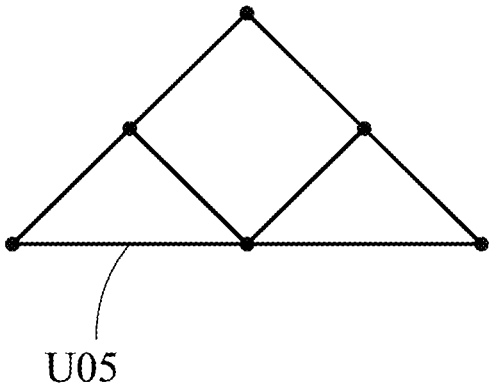
Figure 6D:
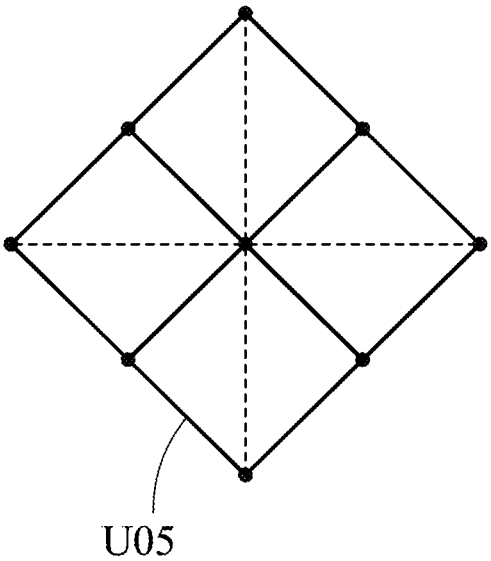
Figure 7A:
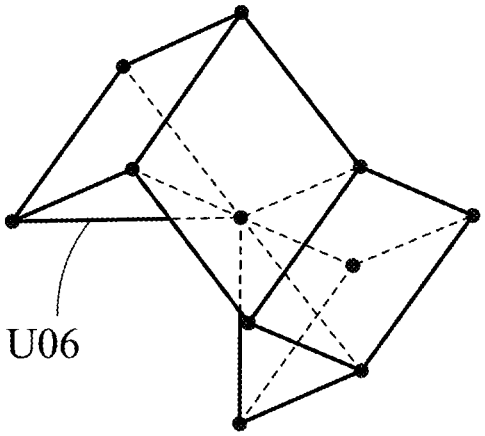
FIG. 7A shows a three-dimensional schematic view of a sixth wooden puzzle of FIG. 1D.
Figure 7B:
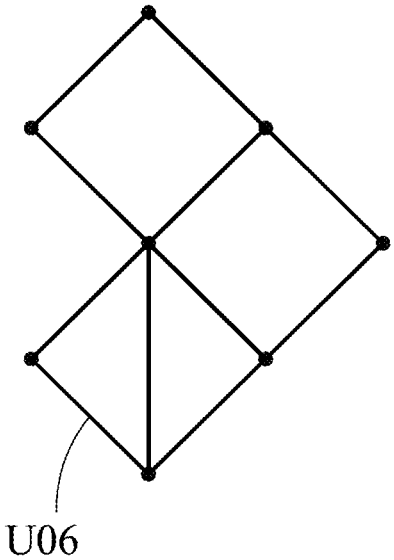
FIGS. 7B, 7C and 7D show three-view drawings of the sixth wooden puzzle of FIG. 1D, respectively.
Figure 7C:
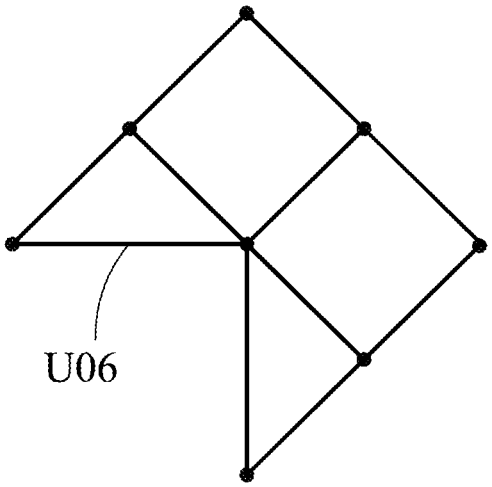
Figure 7D:
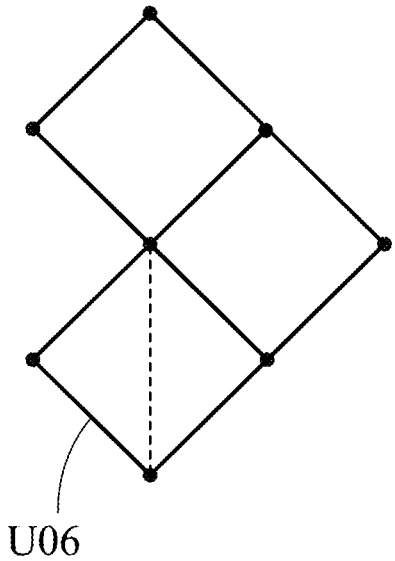
Figure 8A:
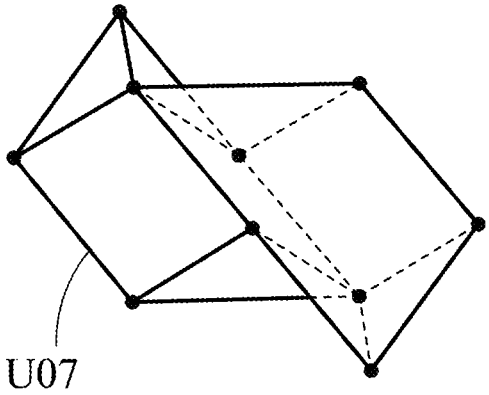
FIG. 8A shows a three-dimensional schematic view of a seventh wooden puzzle of FIG. 1D.
Figure 8B:
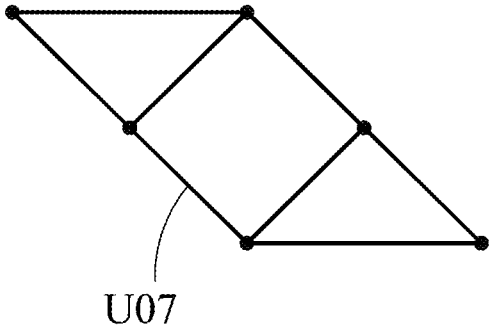
FIGS. 8B, 8C and 8D show three-view drawings of the seventh wooden puzzle of FIG. 1D, respectively.
Figure 8C:
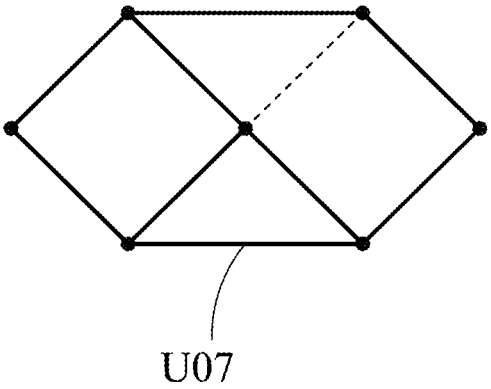
Figure 8D:
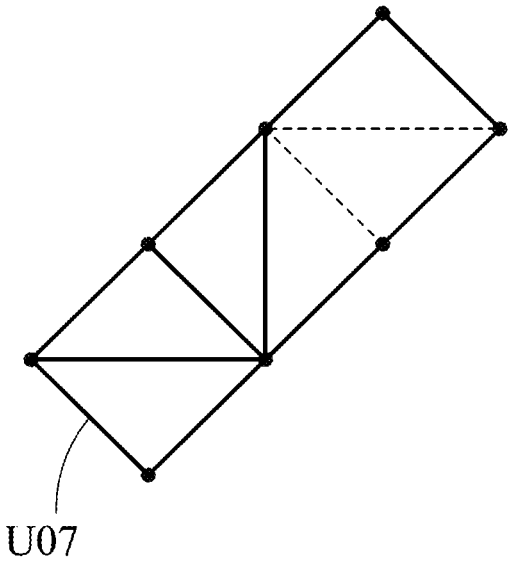
Figure 9A:
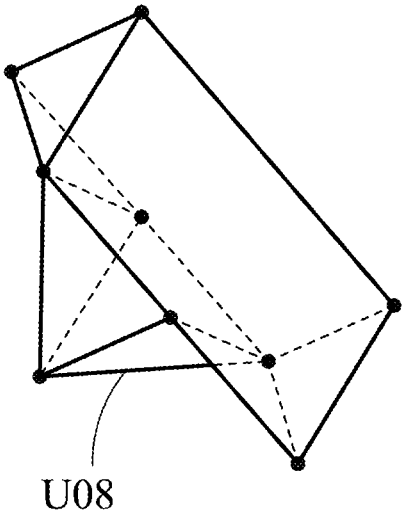
FIG. 9A shows a three-dimensional schematic view of an eighth wooden puzzle of FIG. 1D.
Figure 9B:
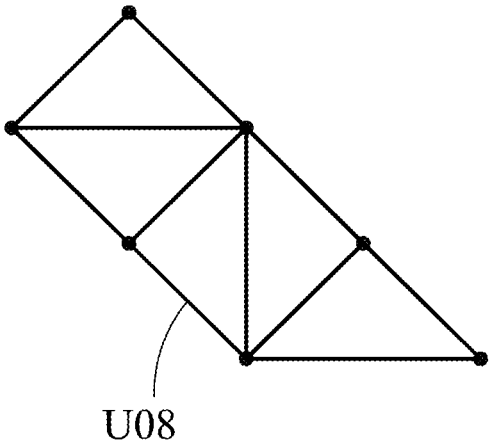
FIGS. 9B, 9C and 9D show three-view drawings of the eighth wooden puzzle of FIG. 1D, respectively.
Figure 9C:
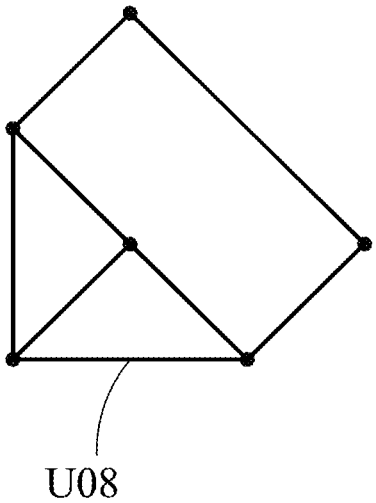
Figure 9D:
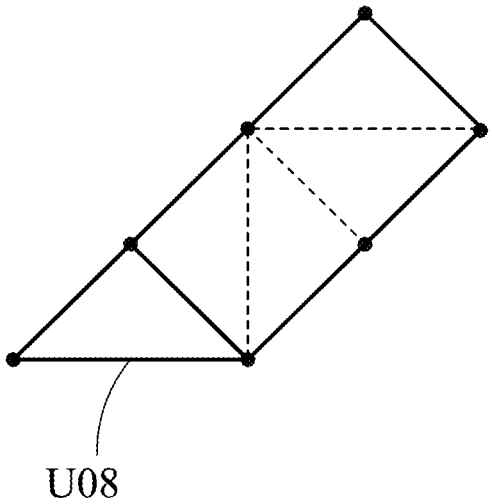
Figure 10A:
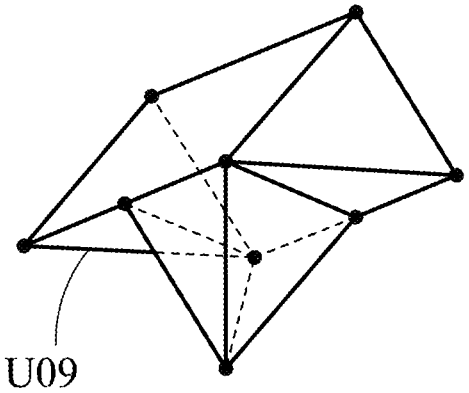
FIG. 10A shows a three-dimensional schematic view of a ninth wooden puzzle of FIG. 1D.
Figure 10B:
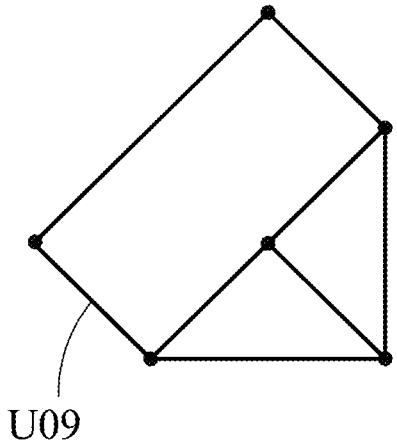
FIGS. 10B, 10C and 10D show three-view drawings of the ninth wooden puzzle of FIG. 1D, respectively.
Figure 10C:
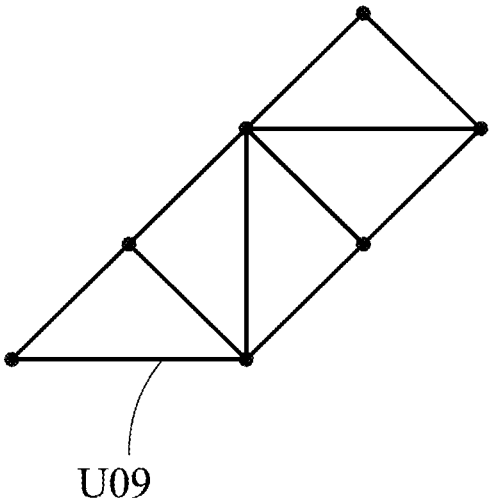
Figure 10D:
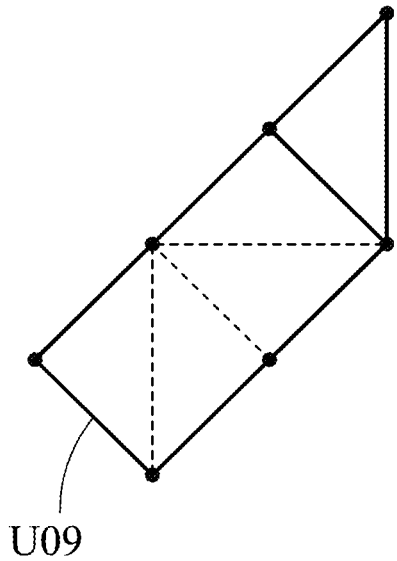
Figure 11A:
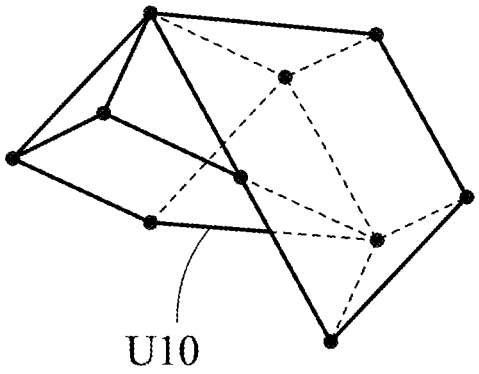
FIG. 11A shows a three-dimensional schematic view of a tenth wooden puzzle of FIG. 1D.
Figure 11B:
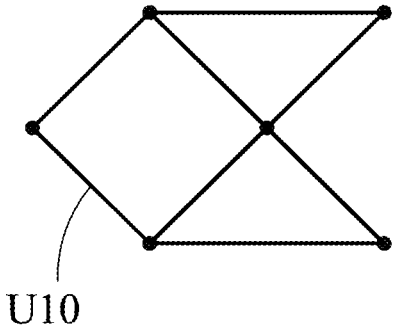
FIGS. 11B, 11C and 11D show three-view drawings of the tenth wooden puzzle of FIG. 1D, respectively.
Figure 11C:
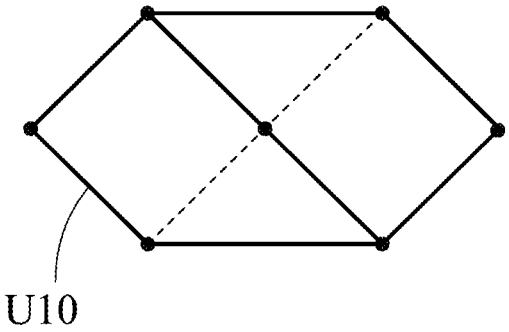
Figure 11D:
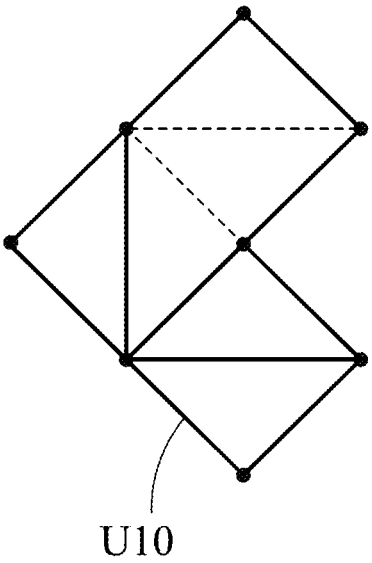
Figure 12A:
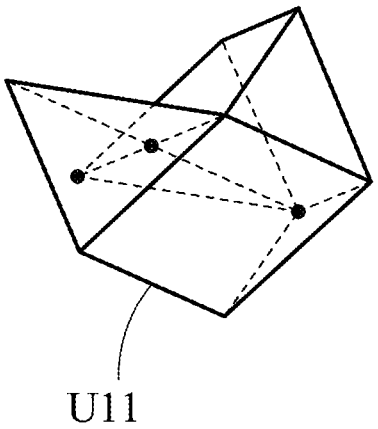
FIG. 12A shows a three-dimensional schematic view of an eleventh wooden puzzle of FIG. 1D.
Figure 12B:
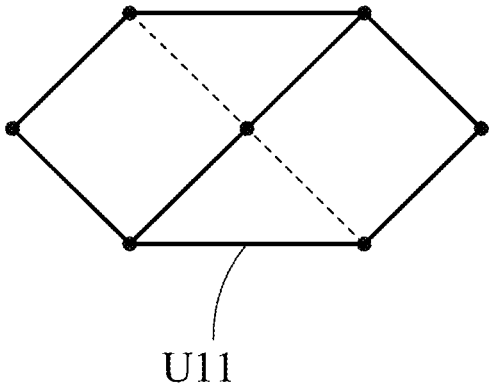
FIGS. 12B, 12C and 12D show three-view drawings of the eleventh wooden puzzle of FIG. 1D, respectively.
Figure 12C:
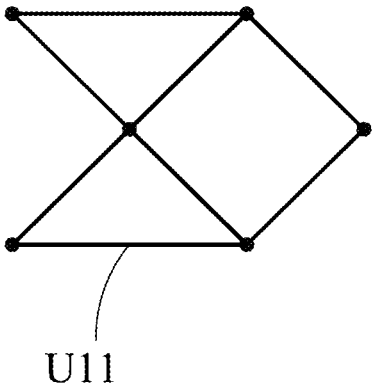
Figure 12D:
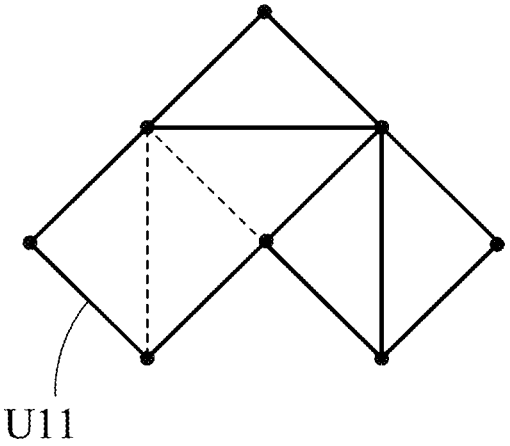

FIG. 1D shows a schematic view of 11 types of wooden puzzles formed by two unit elements 200 of FIG. 1C. FIG. 2A shows a three-dimensional schematic view of a first wooden puzzle U01 of FIG. 1D. FIGS. 2B, 2C and 2D show three-view drawings of the first wooden puzzle U01 of FIG. 1D, respectively. FIG. 3A shows a three-dimensional schematic view of a second wooden puzzle U02 of FIG. 1D. FIGS. 3B, 3C and 3D show three-view drawings of the second wooden puzzle U02 of FIG. 1D, respectively. FIG. 4A shows a three-dimensional schematic view of a third wooden puzzle U03 of FIG. 1D. FIGS. 4B, 4C and 4D show three-view drawings of the third wooden puzzle U03 of FIG. 1D, respectively. FIG. 5A shows a three-dimensional schematic view of a fourth wooden puzzle U04 of FIG. 1D. FIGS. 5B, 5C and 5D show three-view drawings of the fourth wooden puzzle U04 of FIG. 1D, respectively. FIG. 6A shows a three-dimensional schematic view of a fifth wooden puzzle U05 of FIG. 1D. FIGS. 6B, 6C and 6D show three-view drawings of the fifth wooden puzzle U05 of FIG. 1D, respectively. FIG. 7A shows a three-dimensional schematic view of a sixth wooden puzzle U06 of FIG. 1D. FIGS. 7B, 7C and 7D show three-view drawings of the sixth wooden puzzle U06 of FIG. 1D, respectively. FIG. 8A shows a three-dimensional schematic view of a seventh wooden puzzle U07 of FIG. 1D. FIGS. 8B, 8C and 8D show three-view drawings of the seventh wooden puzzle U07 of FIG. 1D, respectively. FIG. 9A shows a three-dimensional schematic view of an eighth wooden puzzle U08 of FIG. 1D. FIGS. 9B, 9C and 9D show three-view drawings of the eighth wooden puzzle U08 of FIG. 1D, respectively. FIG. 10A shows a three-dimensional schematic view of a ninth wooden puzzle U09 of FIG. 1D. FIGS. 10B, 10C and 10D show three-view drawings of the ninth wooden puzzle U09 of FIG. 1D, respectively. FIG. 11A shows a three-dimensional schematic view of a tenth wooden puzzle U10 of FIG. 1D. FIGS. 11B, 11C and 11D show three-view drawings of the tenth wooden puzzle U10 of FIG. 1D, respectively. FIG. 12A shows a three-dimensional schematic view of an eleventh wooden puzzle U11 of FIG. 1D. FIGS. 12B, 12C and 12D show three-view drawings of the eleventh wooden puzzle U11 of FIG. 1D, respectively. The three-view drawings represent a front side view, a right side view and a top side view, respectively. For example, FIGS. 2A-2D show the three-dimensional schematic view, the front side view, the right side view and the top side view of the first wooden puzzle U01, respectively. A specific number of the wooden puzzles with 11 types can be selected to join to each other and arrange in the rhombic dodecahedron or the multiple rhombic dodecahedron so as to form the rhombic dodecahedron puzzle 100 or a multiple rhombic dodecahedron puzzle. Each of the wooden puzzles includes two unit elements 200. The two unit elements 200 are connected to each other and are the same as each other. In addition, the first wooden puzzle U01 is essentially in mirror symmetry with respect to the second wooden puzzle U02. The third wooden puzzle U03 is essentially in mirror symmetry with respect to the fourth wooden puzzle U04. The fifth wooden puzzle U05, the sixth wooden puzzle U06 and the seventh wooden puzzle U07 are the same as themselves after mirroring. The eighth wooden puzzle U08 is essentially in mirror symmetry with respect to the ninth wooden puzzle U09. The tenth wooden puzzle U10 is essentially in mirror symmetry with respect to the eleventh wooden puzzle U11. In order to clearly describe the structure of the two unit elements 200 of each of the wooden puzzles, the six vertices and the central vertex CP of each of the two unit elements 200 are set in the coordinate system, as listed in Table 1.

TABLE 1

| wooden puzzles | coordinate |
|---|---|
| first wooden | (0, 0, 0), (2, 0, 0), (0, 2, 0), (0, 0, 2), (1, 1, 1), (−1, 1, 1), (1, −1, 1) (0, 0, 0), (2, 0, 0), (0, 2, 0), (0, 0, −2), |

TABLE 1-continued

| wooden puzzles | coordinate |
|---|---|
| puzzle U01 | (1, 1, −1), (1, 1, 1), (1, −1, −1) |
| second wooden | (0, 0, 0), (2, 0, 0), (0, 2, 0), (0, 0, 2), (1, 1, 1), (−1, 1, 1), (1, −1, 1) (0, 0, 0), (2, 0, 0), (0, 2, 0), (0, 0, −2), |
| puzzle U02 | (1, 1, −1), (1, 1, 1), (−1, 1, −1) |
| third wooden | (0, 0, 0), (2, 0, 0), (0, 2, 0), (0, 0, 2), (1, 1, 1), (−1, 1, 1), (1, −1, 1) (0, 0, 0), (−2, 0, 0), (0, −2, 0), (0, 0, 2), |
| puzzle U03 | (−1, 1, 1), (−1, −1, 1), (−1, −1, −1) |
| fourth wooden | (0, 0, 0), (2, 0, 0), (0, 2, 0), (0, 0, 2), (1, 1, 1), (−1, 1, 1), (1, −1, 1) (0, 0, 0), (−2, 0, 0), (0, −2, 0), (0, 0, 2), |
| puzzle U04 | (1, −1, 1), (−1 , −1, 1), (−1, −1, −1) |
| fifth wooden | (0, 0, 0), (2, 0, 0), (0, 2, 0), (0, 0, 2), (1, 1, 1), (−1, 1, 1), (1, −1, 1) (0, 0, 0), (2, 0, 0), (0, 2, 0), (0, 0, 2), |
| puzzle U05 | (−1, −1, 1), (−1, 1, 1), (1, −1, 1) |
| sixth wooden | (0, 0, 0), (2, 0, 0), (0, 2, 0), (0, 0, 2), (1, 1, 1), (−1, 1, 1), (1, −1, 1) (0, 0, 0), (−2, 0, 0), (0, 2, 0), (0, 0, −2), |
| puzzle U06 | (−1, 1, 1 ), (−1, 1 , −1), (−1 , −1 , −1) |
| seventh wooden | (0, 0, 0), (2, 0, 0), (0, 2, 0), (0, 0, 2), (1, 1, 1), (−1, 1, 1), (1, −1, 1) (2, 0, 2), (0, 0, 2), (2, −2, 2), (2, 0, 0), |
| puzzle U07 | (1, −1, 1), (3, −1, 1), (1, 1, 1) |
| eighth wooden | (0, 0, 0), (2, 0, 0), (0, 2, 0), (0, 0, 2), (1, 1, 1), (−1, 1, 1), (1, −1, 1) (2, 0, 2), (0, 0, 2), (2, −2, 2), (2, 0, 0), |
| puzzle U08 | (1, −1, 1), (1, −1, 3), (1, 1, 1) |
| ninth wooden | (0, 0, 0), (2, 0, 0), (0, 2, 0), (0, 0, 2), (1, 1, 1), (−1, 1, 1), (1, −1, 1) (0, 2, 2), (0, 0, 2), (−2, 2, 2), (0, 2, 0), |
| puzzle U09 | (−1, 1, 1), (−1, 1, 3), (1, 1, 1) |
| tenth wooden | (0, 0, 0), (2, 0, 0), (0, 2, 0), (0, 0, 2), (1, 1, 1), (−1, 1, 1), (1, −1, 1) (2, 0, 2), (0, 0, 2), (2, 2, 2), (2, 0, 0), (1, −1, 1), |
| puzzle U10 | (3, 1, 1), (1, 1, 1) |
| eleventh wooden | (0, 0, 0), (2, 0, 0), (0, 2, 0), (0, 0, 2), (1, 1, 1), (−1, 1, 1), (1, −1, 1) (0, 2, 2), (0, 0, 2), (2, 2, 2), (0, 2, 0), (−1, 1, 1), |
| puzzle U11 | (1, 3, 1), (1, 1, 1) |

FIGS. 13-50 show three-dimensional schematic views of a six-rhombic dodecahedron puzzle 400 according to a 1st-38th embodiment of the present disclosure, respectively. The six-rhombic dodecahedron puzzle 400 includes a plurality of wooden puzzles arranged in the six-rhombic dodecahedron. The six-rhombic dodecahedron is equivalent to a cube formed by connecting six rhombic dodecahedrons to each other. Each of the wooden puzzles includes two unit elements 200. The two unit elements 200 are connected to each other and are the same as each other. Each of the two unit elements 200 has a plurality of surfaces. Each of the surfaces has a diamond shape or a triangular shape. Two of the surfaces having the triangular shape are connected to each other to form a concave shape, and the surfaces are surrounded to form a closed space. In detail, the wooden puzzles of the six-rhombic dodecahedron puzzle 400 have a plurality of shapes. A number of the shapes is eleven, and a number of the wooden puzzles is eighteen. The six-rhombic dodecahedron puzzle 400 has a six-rhombic dodecahedron volume. The six-rhombic dodecahedron volume is equal to a sum of volumes of the rhombic dodecahedrons. A number of the rhombic dodecahedrons is six, and the volumes of the rhombic dodecahedrons are equal to each other. Moreover, the six-rhombic dodecahedron puzzle 400 can be formed by two first wooden puzzles U01, two second wooden puzzles U02, two third wooden puzzles U03, two fourth wooden puzzles U04, two fifth wooden puzzles U05, two sixth wooden puzzles U06, two seventh wooden puzzles U07, one eighth wooden puzzle U08, one ninth wooden puzzle U09, one tenth wooden puzzle U10 and one eleventh wooden puzzle U11. In other words, the wooden puzzles having 18 pieces with 11 types can be arranged in the six-rhombic dodecahedron puzzles 400 according to the 1st-38th embodiment of the present disclosure. Accordingly, the six-rhombic dodecahedron puzzle 400 of the present disclosure utilizes plural unit elements 200 having the concave bodies to form the 11 types of the wooden puzzles, and the wooden puzzles having 18 pieces with 11 types can be arranged in the six-rhombic dodecahedron puzzles 400 having 38 types, so that there are various types which can be constructed by a player. Furthermore, there is no pattern on any surface of the wooden puzzles. A joining method of the present disclosure is based on the completion of forming the six-rhombic dodecahedron puzzle 400 without pattern matching so as to enhance the problem-solving strategies in geometry.

Figure 13:
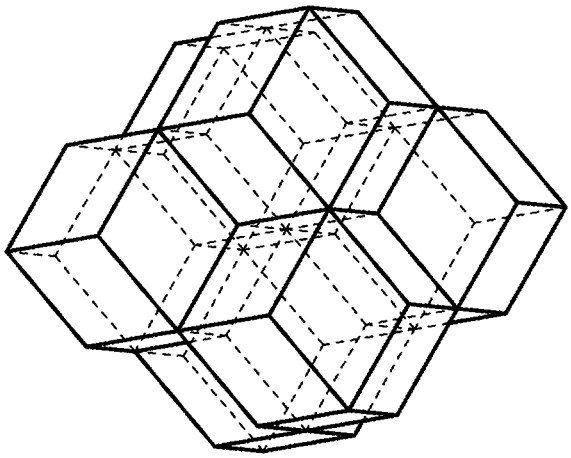
FIG. 13 shows a three-dimensional schematic view of a multiple rhombic dodecahedron puzzle according to a 1st embodiment of the present disclosure.
Figure 14:
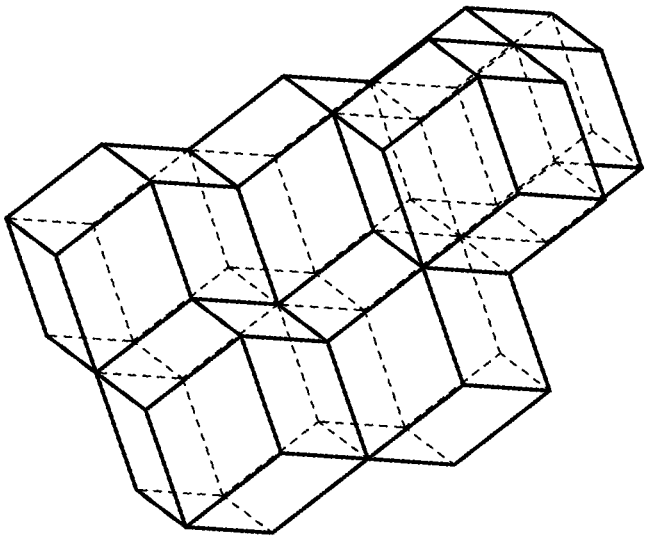
FIG. 14 shows a three-dimensional schematic view of a multiple rhombic dodecahedron puzzle according to a 2nd embodiment of the present disclosure.
Figure 15:
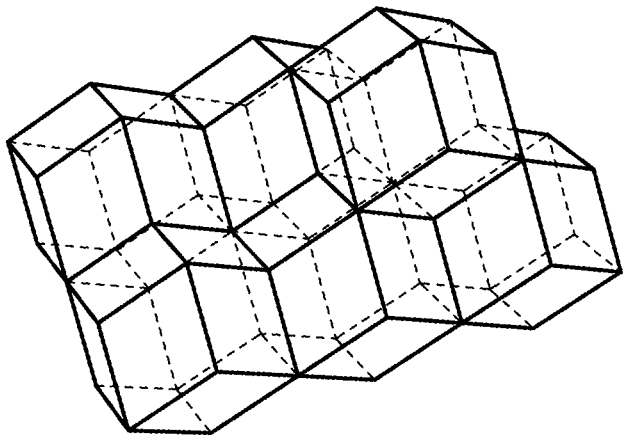
FIG. 15 shows a three-dimensional schematic view of a multiple rhombic dodecahedron puzzle according to a 3rd embodiment of the present disclosure.
Figure 16:
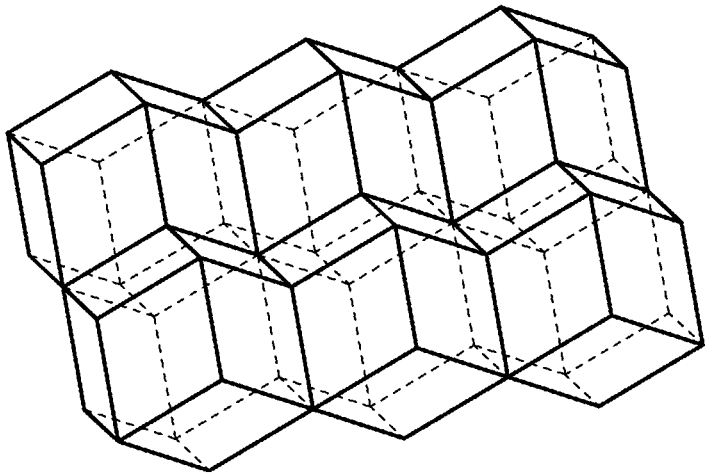
FIG. 16 shows a three-dimensional schematic view of a multiple rhombic dodecahedron puzzle according to a 4th embodiment of the present disclosure.
Figure 17:
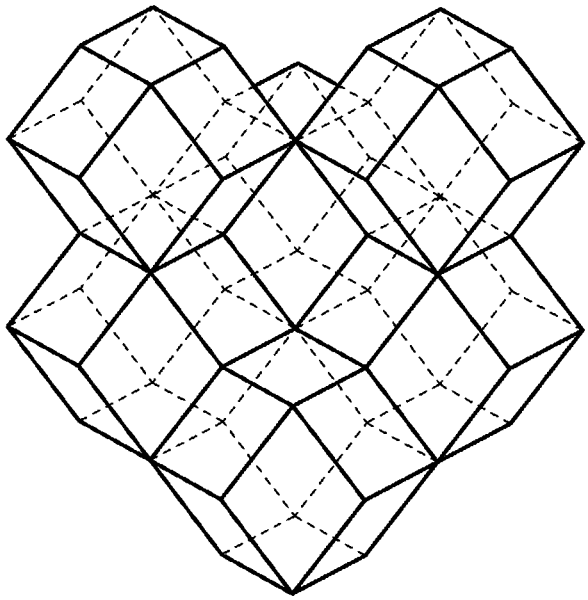
FIG. 17 shows a three-dimensional schematic view of a multiple rhombic dodecahedron puzzle according to a 5th embodiment of the present disclosure.
Figure 18:
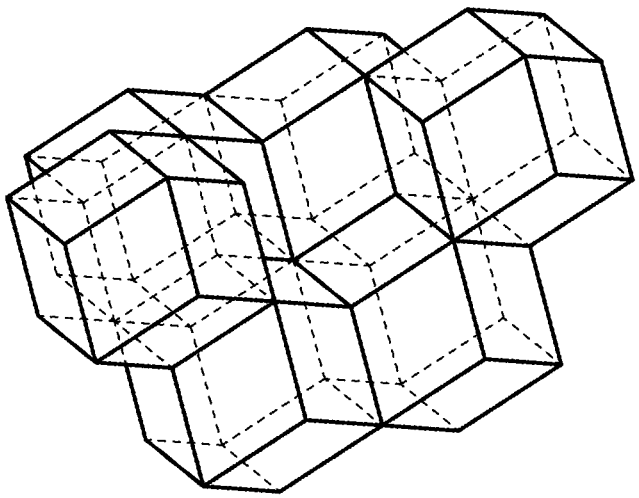
FIG. 18 shows a three-dimensional schematic view of a multiple rhombic dodecahedron puzzle according to a 6th embodiment of the present disclosure.
Figure 19:
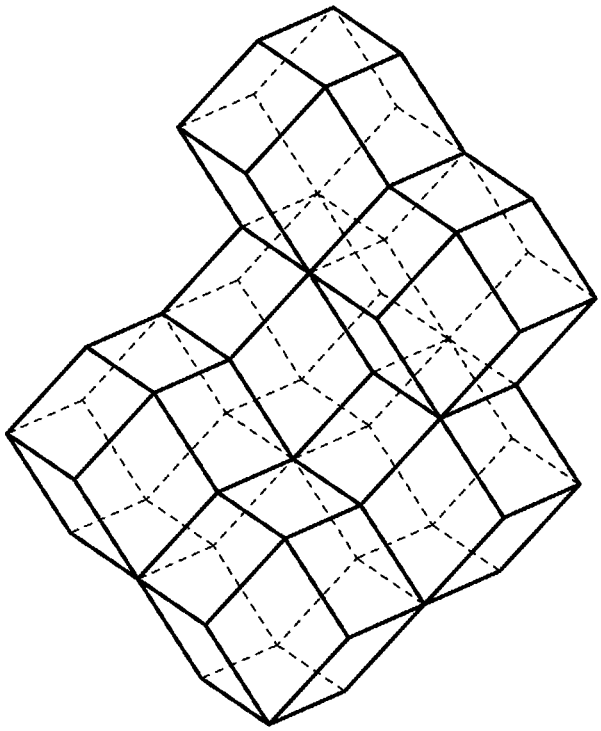
FIG. 19 shows a three-dimensional schematic view of a multiple rhombic dodecahedron puzzle according to a 7th embodiment of the present disclosure.
Figure 20:
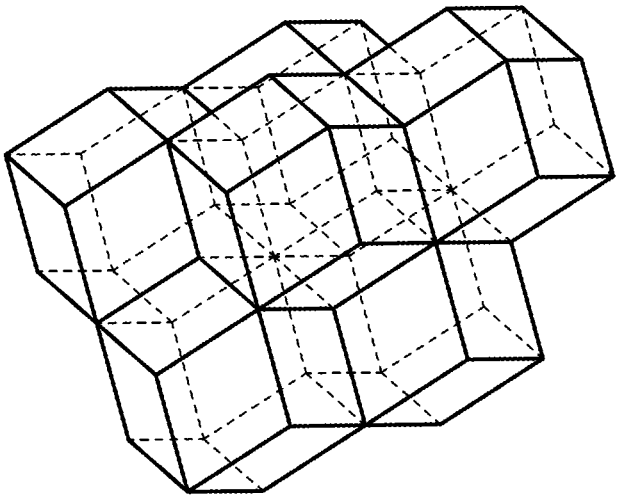
FIG. 20 shows a three-dimensional schematic view of a multiple rhombic dodecahedron puzzle according to an 8th embodiment of the present disclosure.
Figure 21:
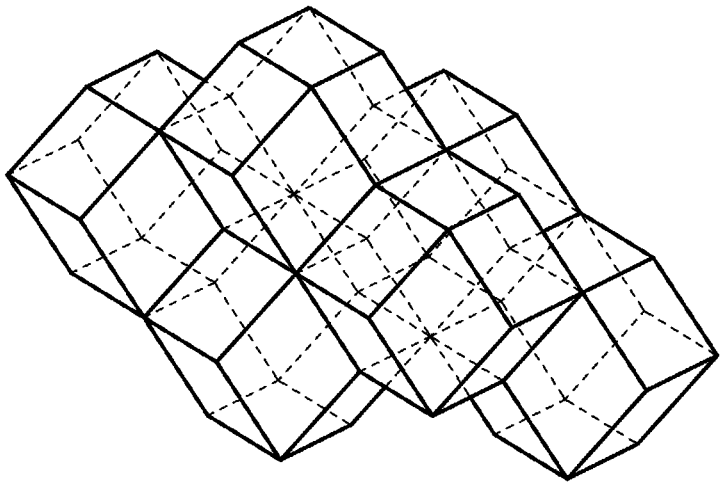
FIG. 21 shows a three-dimensional schematic view of a multiple rhombic dodecahedron puzzle according to a 9th embodiment of the present disclosure.
Figure 22:
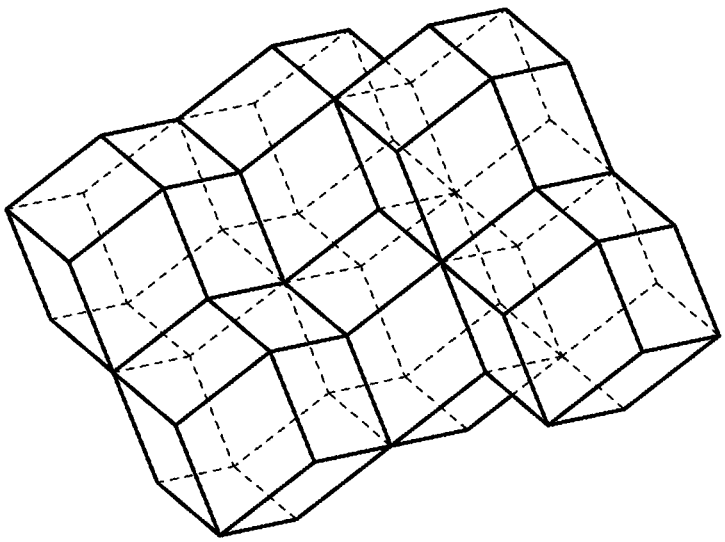
FIG. 22 shows a three-dimensional schematic view of a multiple rhombic dodecahedron puzzle according to a 10th embodiment of the present disclosure.
Figure 23:
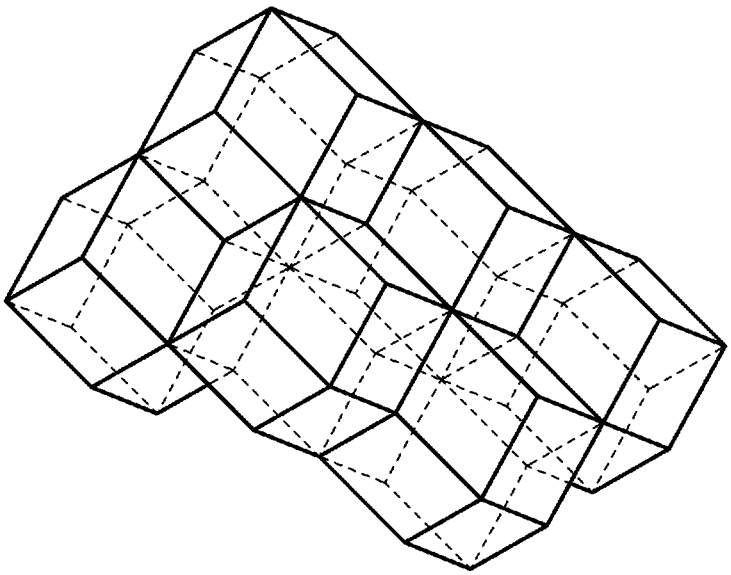
FIG. 23 shows a three-dimensional schematic view of a multiple rhombic dodecahedron puzzle according to an 11th embodiment of the present disclosure.
Figure 24:
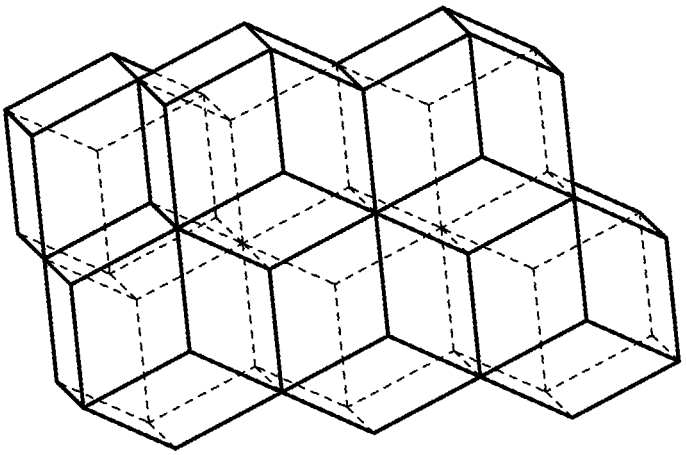
FIG. 24 shows a three-dimensional schematic view of a multiple rhombic dodecahedron puzzle according to a 12th embodiment of the present disclosure.
Figure 25:
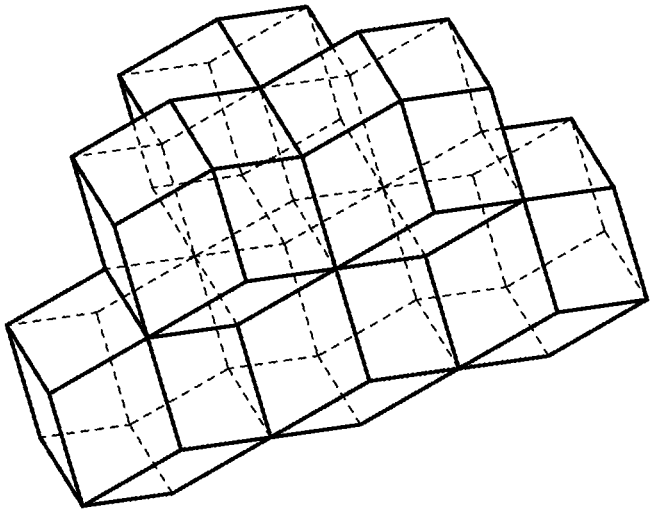
FIG. 25 shows a three-dimensional schematic view of a multiple rhombic dodecahedron puzzle according to a 13th embodiment of the present disclosure.
Figure 26:
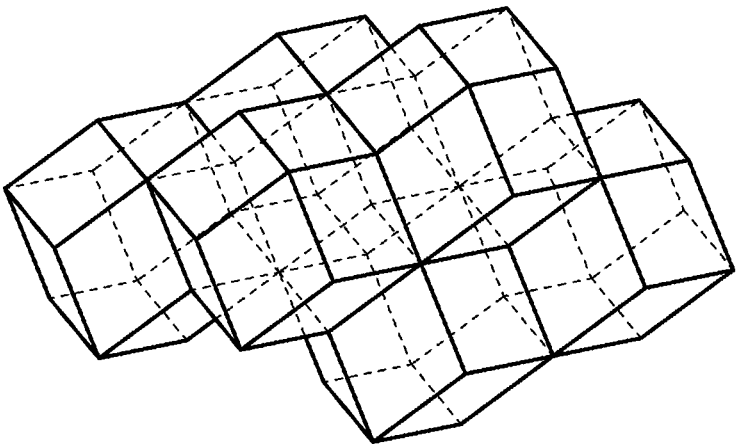
FIG. 26 shows a three-dimensional schematic view of a multiple rhombic dodecahedron puzzle according to a 14th embodiment of the present disclosure.
Figure 27:
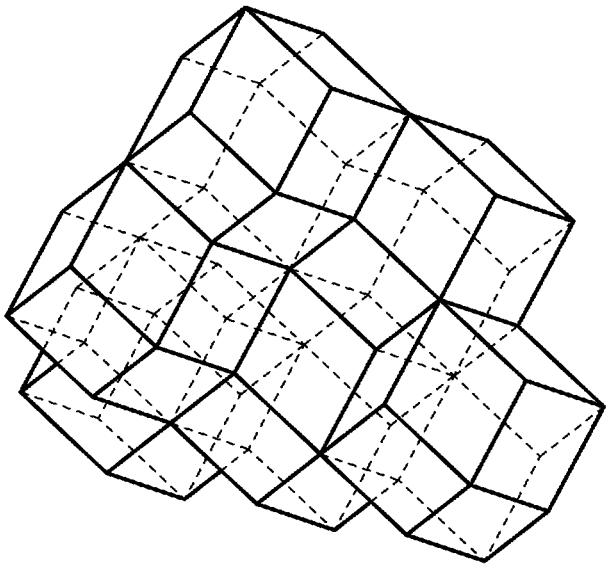
FIG. 27 shows a three-dimensional schematic view of a multiple rhombic dodecahedron puzzle according to a 15th embodiment of the present disclosure.
Figure 28:
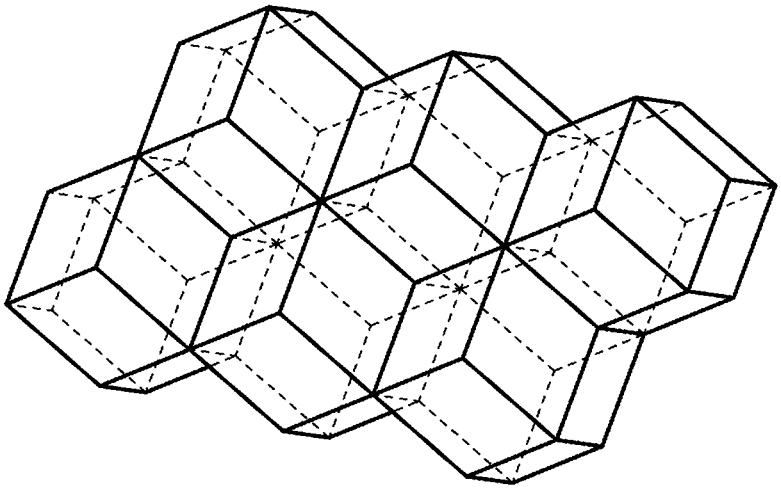
FIG. 28 shows a three-dimensional schematic view of a multiple rhombic dodecahedron puzzle according to a 16th embodiment of the present disclosure.
Figure 29:
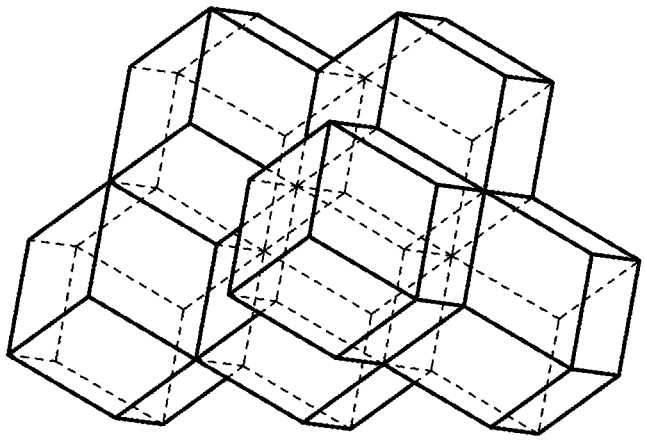
FIG. 29 shows a three-dimensional schematic view of a multiple rhombic dodecahedron puzzle according to a 17th embodiment of the present disclosure.
Figure 30:
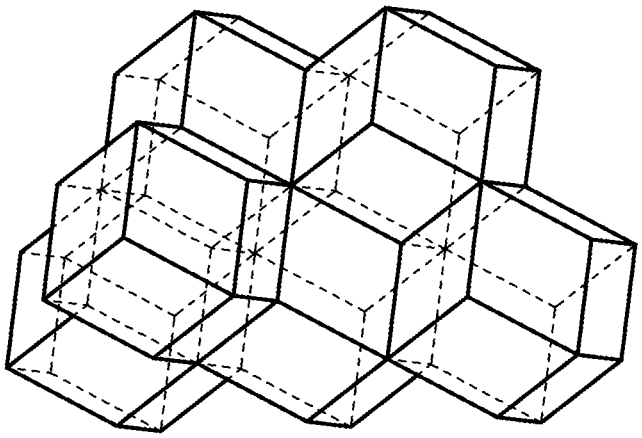
FIG. 30 shows a three-dimensional schematic view of a multiple rhombic dodecahedron puzzle according to an 18th embodiment of the present disclosure.
Figure 31:
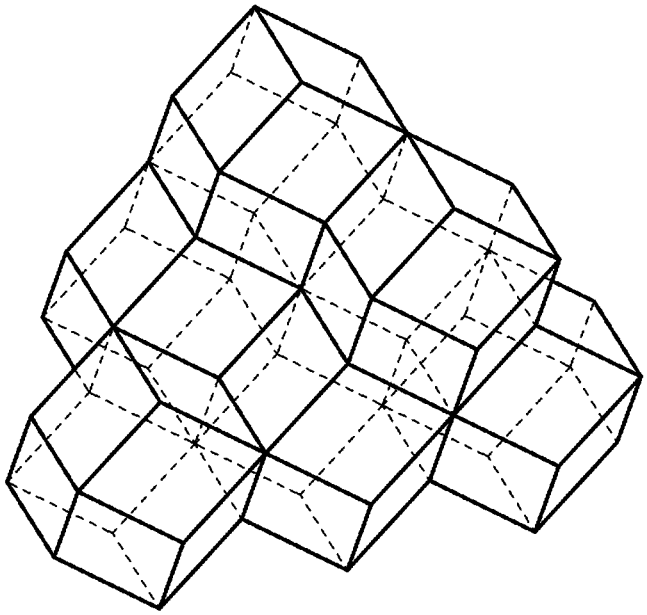
FIG. 31 shows a three-dimensional schematic view of a multiple rhombic dodecahedron puzzle according to a 19th embodiment of the present disclosure.
Figure 32:
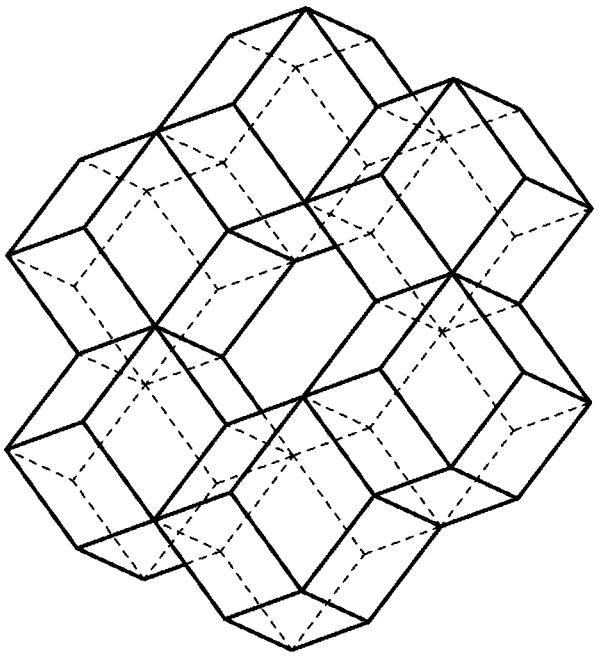
FIG. 32 shows a three-dimensional schematic view of a multiple rhombic dodecahedron puzzle according to a 20th embodiment of the present disclosure.
Figure 33:
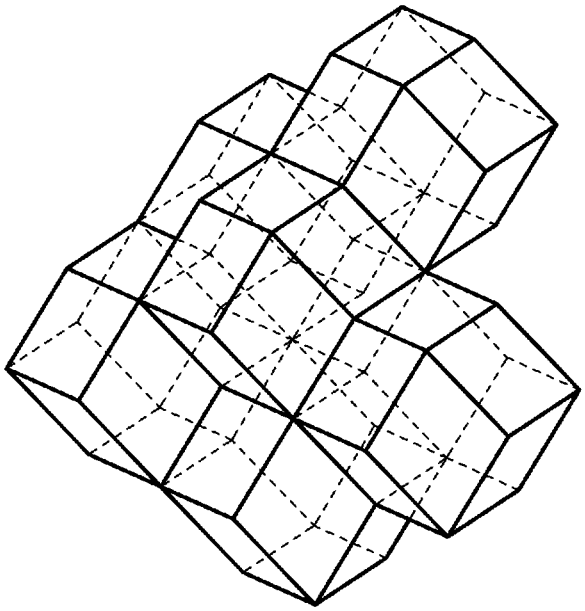
FIG. 33 shows a three-dimensional schematic view of a multiple rhombic dodecahedron puzzle according to a 21st embodiment of the present disclosure.
Figure 34:
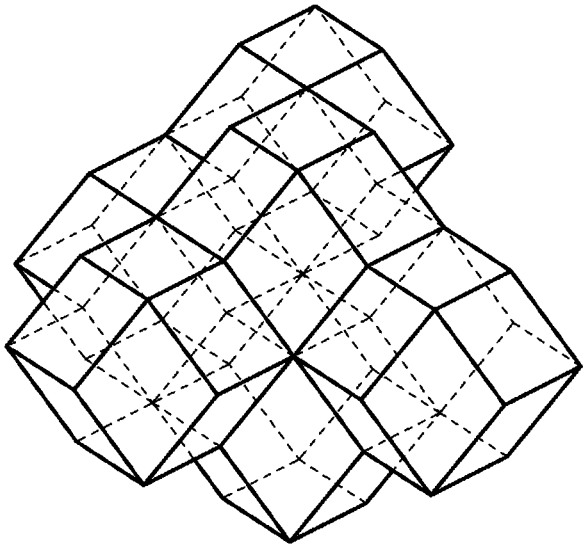
FIG. 34 shows a three-dimensional schematic view of a multiple rhombic dodecahedron puzzle according to a 22nd embodiment of the present disclosure.
Figure 35:
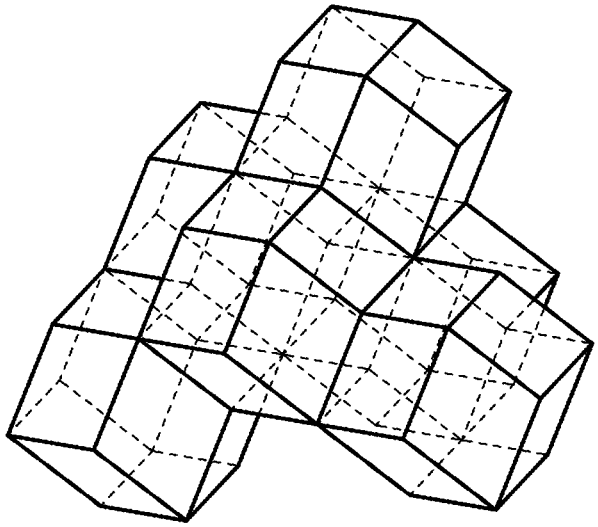
FIG. 35 shows a three-dimensional schematic view of a multiple rhombic dodecahedron puzzle according to a 23th embodiment of the present disclosure.
Figure 36:
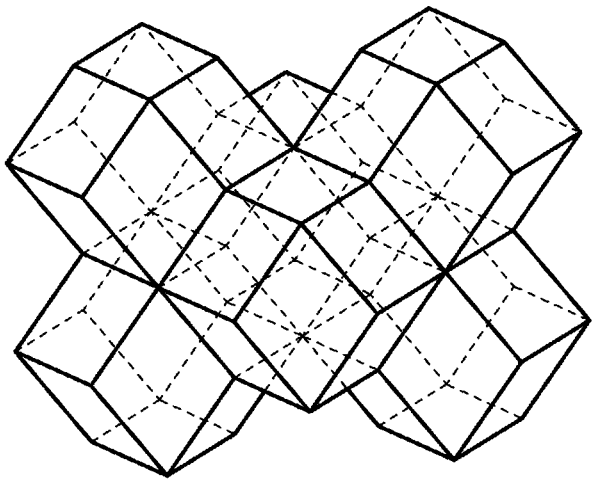
FIG. 36 shows a three-dimensional schematic view of a multiple rhombic dodecahedron puzzle according to a 24th embodiment of the present disclosure.
Figure 37:
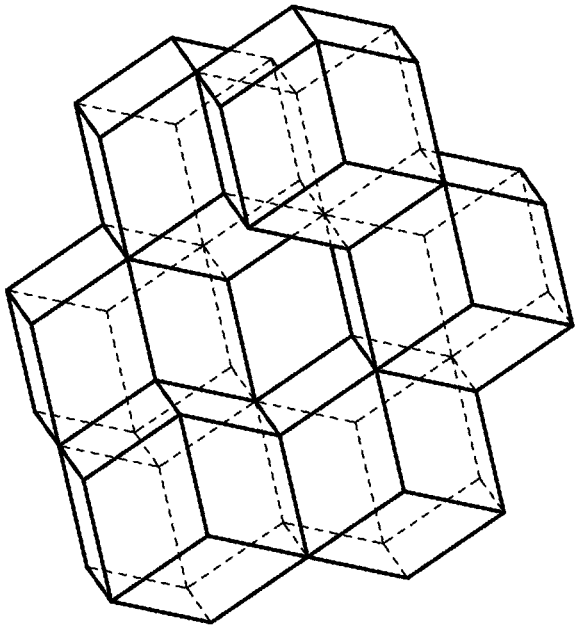
FIG. 37 shows a three-dimensional schematic view of a multiple rhombic dodecahedron puzzle according to a 25th embodiment of the present disclosure.
Figure 38:
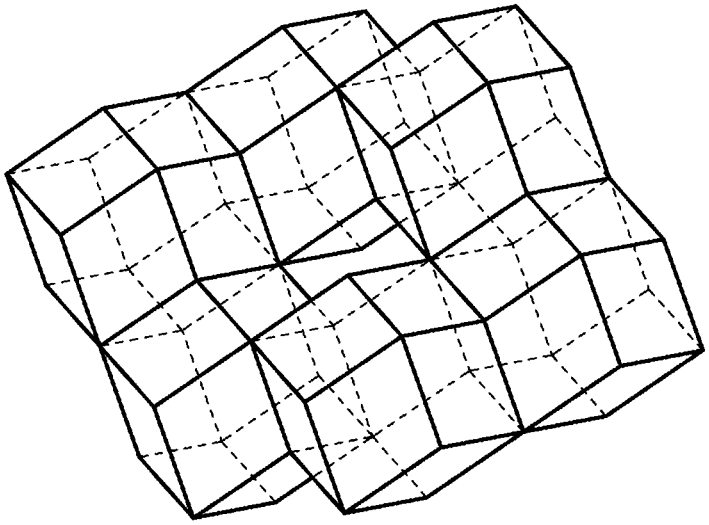
FIG. 38 shows a three-dimensional schematic view of a multiple rhombic dodecahedron puzzle according to a 26th embodiment of the present disclosure.
Figure 39:
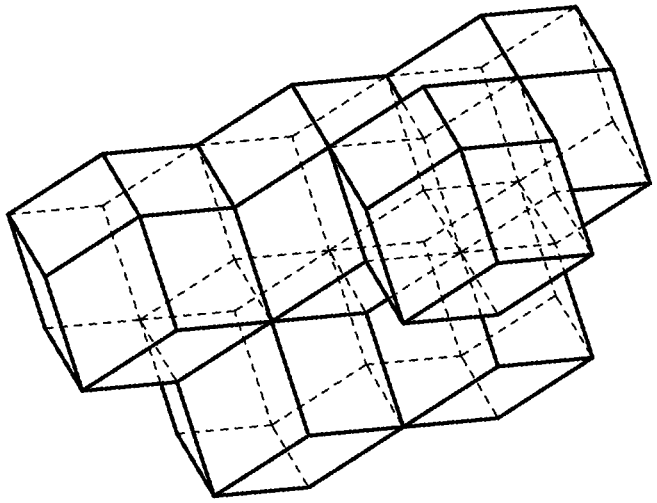
FIG. 39 shows a three-dimensional schematic view of a multiple rhombic dodecahedron puzzle according to a 27th embodiment of the present disclosure.
Figure 40:
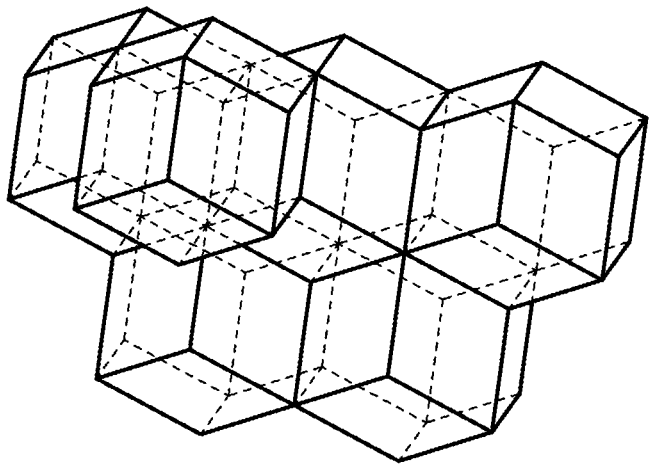
FIG. 40 shows a three-dimensional schematic view of a multiple rhombic dodecahedron puzzle according to a 28th embodiment of the present disclosure.
Figure 41:
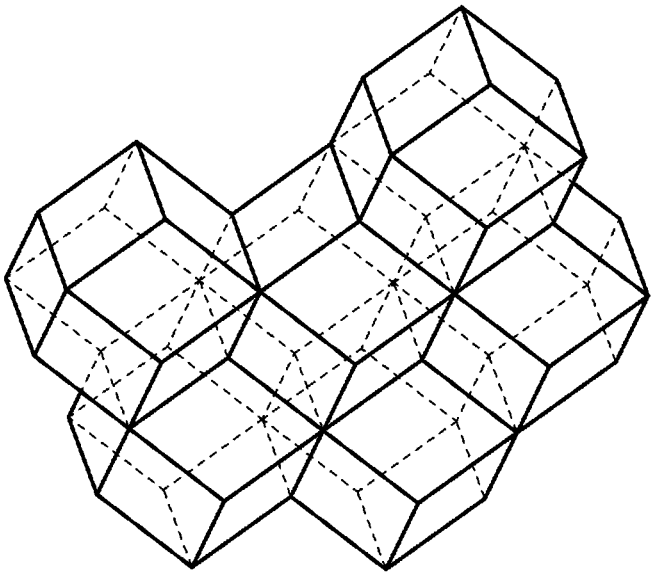
FIG. 41 shows a three-dimensional schematic view of a multiple rhombic dodecahedron puzzle according to a 29th embodiment of the present disclosure.
Figure 42:
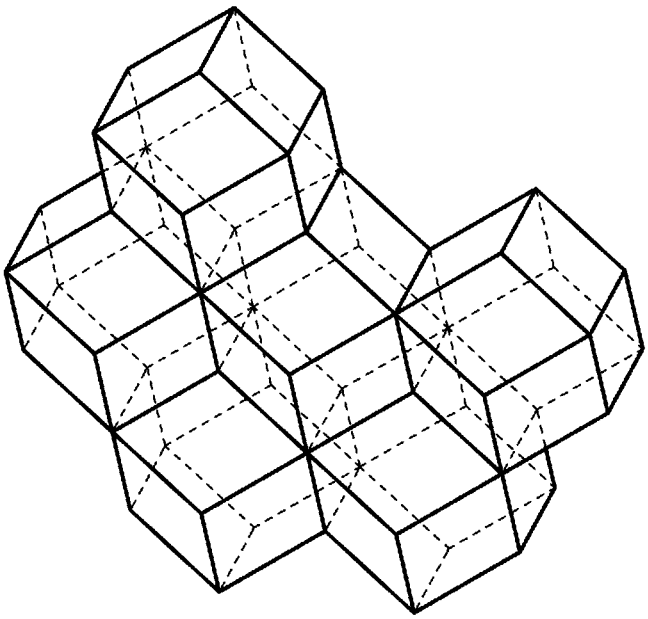
FIG. 42 shows a three-dimensional schematic view of a multiple rhombic dodecahedron puzzle according to a 30th embodiment of the present disclosure.
Figure 43:
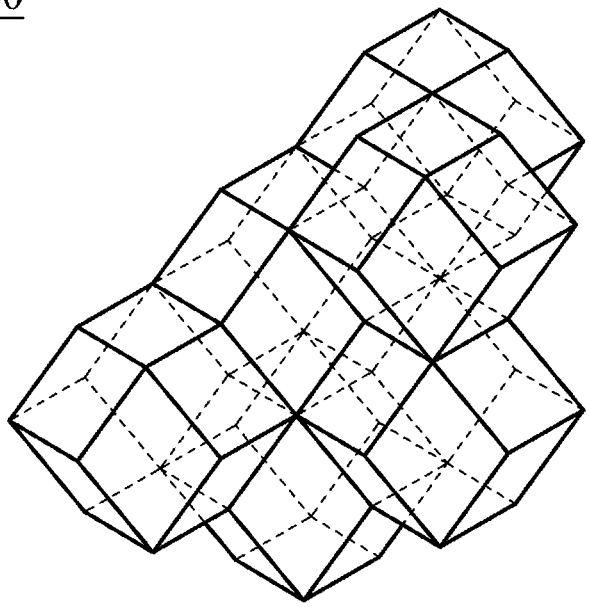
FIG. 43 shows a three-dimensional schematic view of a multiple rhombic dodecahedron puzzle according to a 31st embodiment of the present disclosure.
Figure 44:
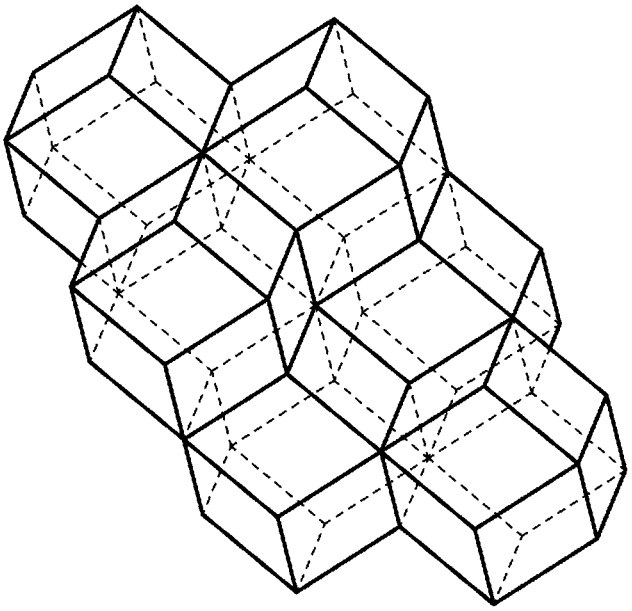
FIG. 44 shows a three-dimensional schematic view of a multiple rhombic dodecahedron puzzle according to a 32nd embodiment of the present disclosure.
Figure 45:
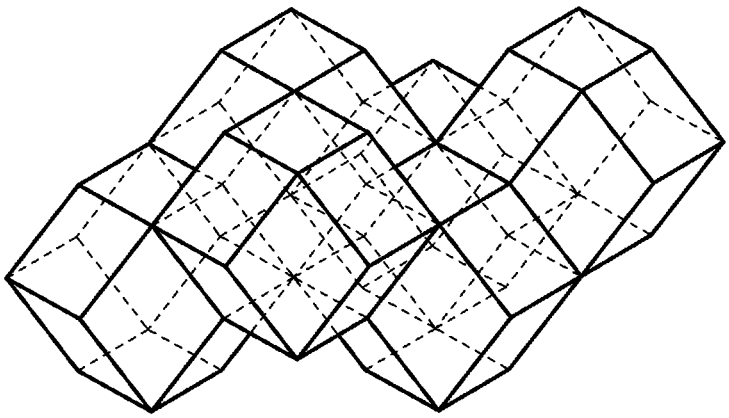
FIG. 45 shows a three-dimensional schematic view of a multiple rhombic dodecahedron puzzle according to a 33th embodiment of the present disclosure.
Figure 46:
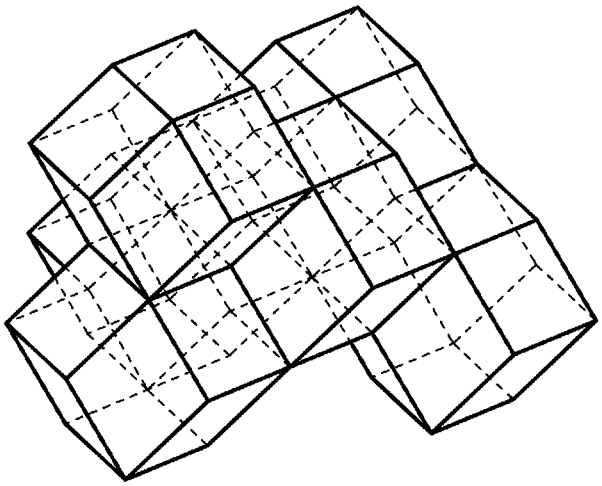
FIG. 46 shows a three-dimensional schematic view of a multiple rhombic dodecahedron puzzle according to a 34th embodiment of the present disclosure.
Figure 47:
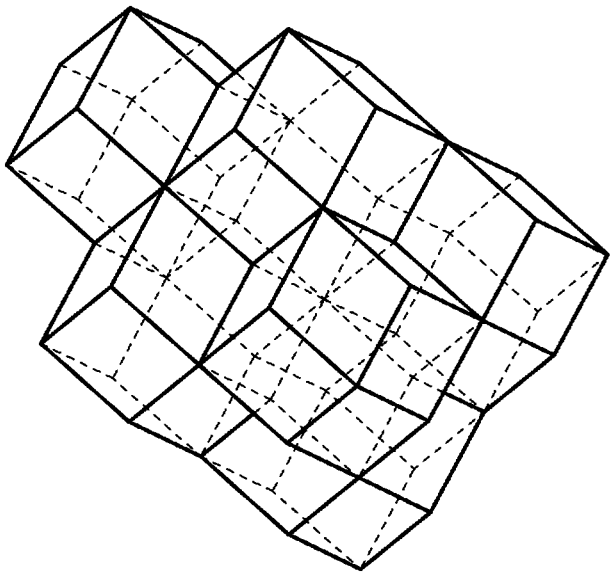
FIG. 47 shows a three-dimensional schematic view of a multiple rhombic dodecahedron puzzle according to a 35th embodiment of the present disclosure.
Figure 48:
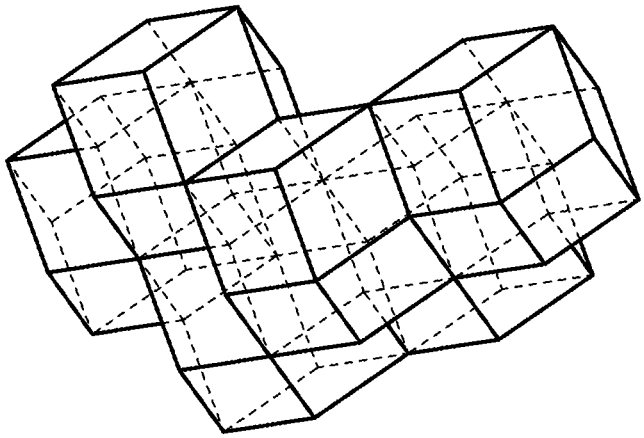
FIG. 48 shows a three-dimensional schematic view of a multiple rhombic dodecahedron puzzle according to a 36th embodiment of the present disclosure.
Figure 49:
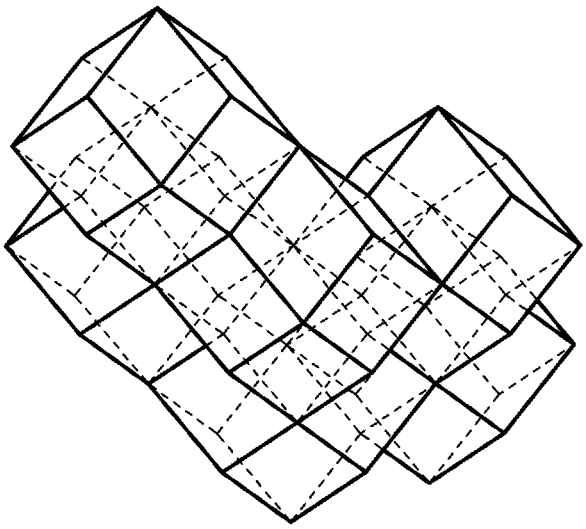
FIG. 49 shows a three-dimensional schematic view of a multiple rhombic dodecahedron puzzle according to a 37th embodiment of the present disclosure.
Figure 50:
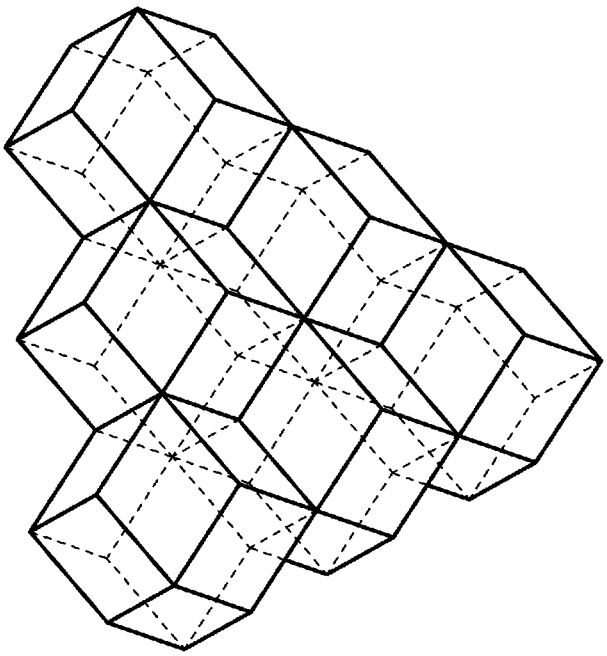
FIG. 50 shows a three-dimensional schematic view of a multiple rhombic dodecahedron puzzle according to a 38th embodiment of the present disclosure.

In FIGS. 1D and 13, the six-rhombic dodecahedron puzzle of the 1st embodiment of the present disclosure can be formed by sequentially joining the third wooden puzzle U03, the fourth wooden puzzle U04, the eighth wooden puzzle U08, the seventh wooden puzzle U07, the tenth wooden puzzle U10, the first wooden puzzle U01, the sixth wooden puzzle U06, the third wooden puzzle U03, the fourth wooden puzzle U04, the sixth wooden puzzle U06, the second wooden puzzle U02, the ninth wooden puzzle U09, the fifth wooden puzzle U05, the eleventh wooden puzzle U11, the seventh wooden puzzle U07, the first wooden puzzle U01, the second wooden puzzle U02 and the fifth wooden puzzle U05. In other words, the wooden puzzles having 18 pieces with 11 types in FIG. 1D can be sequentially joined and arranged in the six-rhombic dodecahedron puzzles 400 of FIG. 13. Therefore, the six-rhombic dodecahedron puzzles 400 of the present disclosure may be accomplished by sequentially joining the specific wooden puzzles so as to achieve special aesthetic effects.

Figure 51:
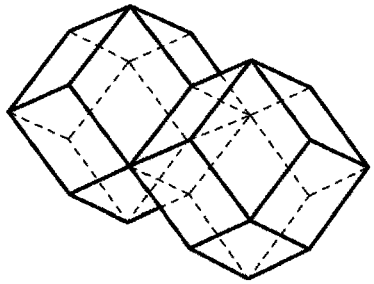
FIG. 51 shows a three-dimensional schematic view of a two-rhombic dodecahedron puzzle according to one embodiment of the present disclosure.
Figure 52:
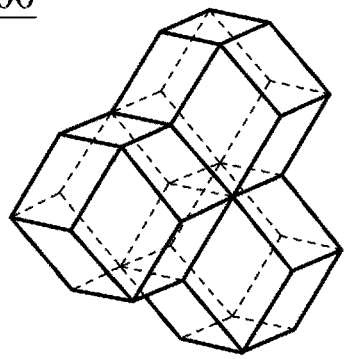
FIG. 52 shows a three-dimensional schematic view of a three-rhombic dodecahedron puzzle according to one embodiment of the present disclosure.
Figure 53A:
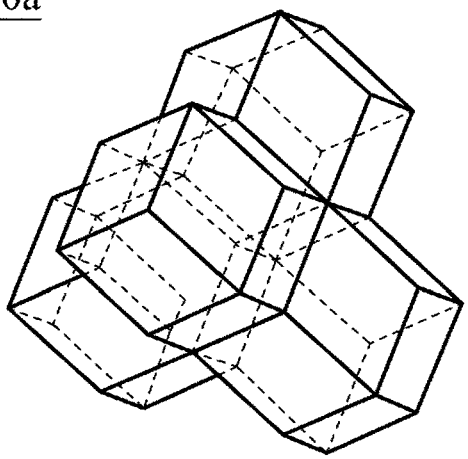
FIG. 53A shows a three-dimensional schematic view of a four-rhombic dodecahedron puzzle according to one embodiment of the present disclosure.
Figure 53B:
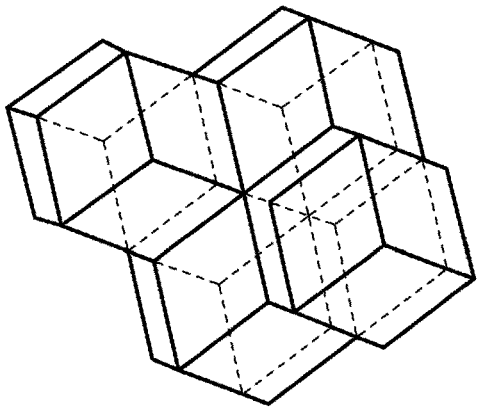
FIG. 53B shows a three-dimensional schematic view of a four-rhombic dodecahedron puzzle according to another embodiment of the present disclosure.
Figure 54A:
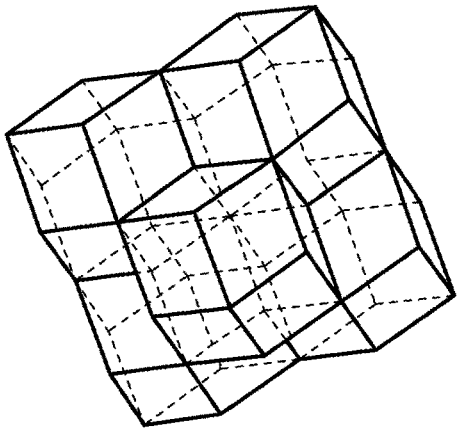
FIG. 54A shows a three-dimensional schematic view of a five-rhombic dodecahedron puzzle according to one embodiment of the present disclosure.
Figure 54B:
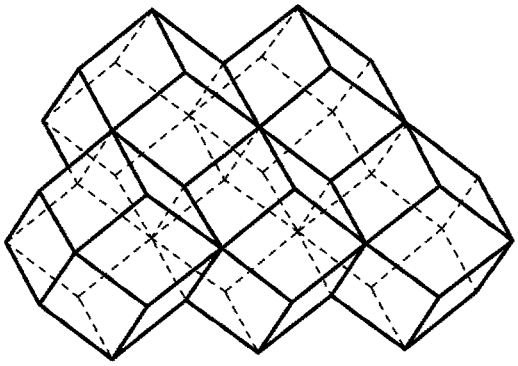
FIG. 54B shows a three-dimensional schematic view of a five-rhombic dodecahedron puzzle according to another embodiment of the present disclosure.

FIG. 51 shows a three-dimensional schematic view of a two-rhombic dodecahedron puzzle 500 according to one embodiment of the present disclosure; FIG. 52 shows a three-dimensional schematic view of a three-rhombic dodecahedron puzzle 600 according to one embodiment of the present disclosure; FIG. 53A shows a three-dimensional schematic view of a four-rhombic dodecahedron puzzle 700*a* according to one embodiment of the present disclosure; FIG. 53B shows a three-dimensional schematic view of a four-rhombic dodecahedron puzzle 700*b* according to another embodiment of the present disclosure; FIG. 54A shows a three-dimensional schematic view of a five-rhombic dodecahedron puzzle 800*a* according to one embodiment of the present disclosure; and FIG. 54B shows a three-dimensional schematic view of a five-rhombic dodecahedron puzzle 800*b* according to another embodiment of the present disclosure. A specific number of the wooden puzzles having 18 pieces with 11 types can be selected to join to each other and arrange in the rhombic dodecahedron puzzle 100, the two-rhombic dodecahedron puzzle 500, the three-rhombic dodecahedron puzzle 600, the four-rhombic dodecahedron puzzle 700*a*, the four-rhombic dodecahedron puzzle 700*b*, the five-rhombic dodecahedron puzzle 800*a* or the five-rhombic dodecahedron puzzle 800*b*. For example, the rhombic dodecahedron puzzle 100 of FIG. 1A may be formed by sequentially joining the second wooden puzzle U02, the third wooden puzzle U03 and the fourth wooden puzzle U04. In other words, a number of the wooden puzzles is three in FIG. 1A. The two-rhombic dodecahedron puzzle 500 of FIG. 51 may be formed by sequentially joining the second wooden puzzle U02, the third wooden puzzle U03, the fourth wooden puzzle U04, the second wooden puzzle U02, the third wooden puzzle U03 and the fourth wooden puzzle U04. The three-rhombic dodecahedron puzzle 600 of FIG. 52 may be formed by sequentially joining the first wooden puzzle U01, the first wooden puzzle U01, the fifth wooden puzzle U05, the second wooden puzzle U02, the third wooden puzzle U03, the fourth wooden puzzle U04, the second wooden puzzle U02, the third wooden puzzle U03 and the fourth wooden puzzle U04. The four-rhombic dodecahedron puzzle 700*a* of FIG. 53A may be formed by sequentially joining the first wooden puzzle U01, the seventh wooden puzzle U07, the seventh wooden puzzle U07, the second wooden puzzle U02, the third wooden puzzle U03, the fourth wooden puzzle U04, the tenth wooden puzzle U10, the third wooden puzzle U03, the sixth wooden puzzle U06, the sixth wooden puzzle U06, the second wooden puzzle U02 and the first wooden puzzle U01. The five-rhombic dodecahedron puzzle 800*a* of FIG. 54A may be formed by sequentially joining the first wooden puzzle U01, the seventh wooden puzzle U07, the seventh wooden puzzle U07, the second wooden puzzle U02, the third wooden puzzle U03, the eleventh wooden puzzle U11, the fourth wooden puzzle U04, the fifth wooden puzzle U05, the fourth wooden puzzle U04, the tenth wooden puzzle U10, the third wooden puzzle U03, the sixth wooden puzzle U06, the sixth wooden puzzle U06, the second wooden puzzle U02 and the first wooden puzzle U01. The joining method of the present disclosure does not only have one solution, with different wooden puzzles can be selected to join to each other and arrange in the same structure. Accordingly, in the present disclosure, the specific number of the wooden puzzles can be selected to join to each other and arrange in the rhombic dodecahedron puzzle 100, the two-rhombic dodecahedron puzzle 500, the three-rhombic dodecahedron puzzle 600, the four-rhombic dodecahedron puzzle 700*a*, the four-rhombic dodecahedron puzzle 700*b*, the five-rhombic dodecahedron puzzle 800*a* or the five-rhombic dodecahedron puzzle 800*b*. If the player wants to arrange the wooden puzzles in the six-rhombic dodecahedron puzzles 400, there is no separated rhombic dodecahedron in the six-rhombic dodecahedron puzzles 400 after the six-rhombic dodecahedron puzzles 400 is formed. Hence, the present disclosure utilizes the specific wooden puzzles to form the rhombic dodecahedron puzzle 100 and many types of the multiple rhombic dodecahedron puzzles, so that the rhombic dodecahedron puzzle 100 and the multiple rhombic dodecahedron puzzle of the present disclosure are appropriate for all ages and can cultivate the abilities of spatial rotation and mental rotation. As compared to conventional puzzles, the unique shapes of the present disclosure increase challenge and enhance the problem-solving strategies in geometry. Moreover, the present disclosure provides a very enjoyable and educational experience.

Figure 55A:
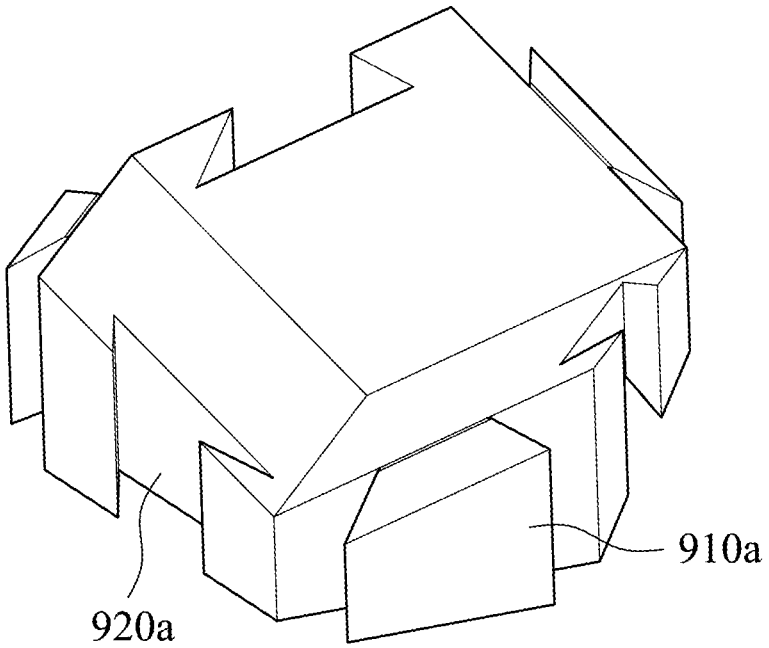
FIG. 55A shows a three-dimensional schematic view of a base of the rhombic dodecahedron puzzle of FIG. 1A.
Figure 55B:
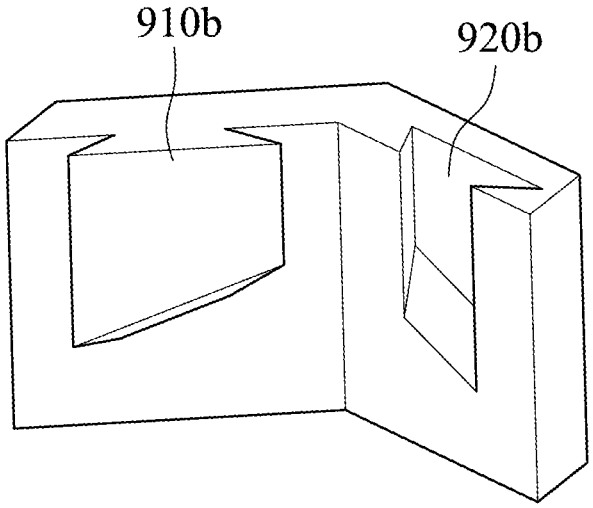
FIG. 55B shows a three-dimensional schematic view of a base wall of the rhombic dodecahedron puzzle of FIG. 1A.

FIG. 55A shows a three-dimensional schematic view of a base 900*a* of the rhombic dodecahedron puzzle 100 of FIG. 1A; and FIG. 55B shows a three-dimensional schematic view of a base wall 900*b* of the rhombic dodecahedron puzzle 100 of FIG. 1A. The rhombic dodecahedron puzzle 100 includes the base 900*a* and the base wall 900*b*. The base 900*a* is detachably connected to the wooden puzzles and includes a first convex portion 910*a* and a first concave portion 920*a*. The base 900*a* is configured to carry and support the wooden puzzles. The base wall 900*b* is detachably connected to the base 900*a* and includes a second convex portion 910*b* and a second concave portion 920*b*. The second convex portion 910*b* is correspondingly engaged with the first concave portion 920*a*, and the first convex portion 910*a* is correspondingly engaged with the second concave portion 920*b*. Therefore, the rhombic dodecahedron puzzle 100 or the multiple rhombic dodecahedron puzzle utilizes the base 900*a* engaged with the base wall 900*b* to carry and support the wooden puzzles, thereby stably positioning the rhombic dodecahedron or the multiple rhombic dodecahedron.

In the above-mentioned embodiments, a joining operation of any two of the wooden puzzles can be realized by various joining methods, such as magnetic attraction, engaging connection, adhesive connection. The joining methods are often applied in the conventional technology, and will not be described again herein.

According to the aforementioned embodiments and examples, the advantages of the present disclosure are described as follows.

1. The rhombic dodecahedron puzzle and the multiple rhombic dodecahedron puzzle of the present disclosure utilizes plural unit elements having the concave bodies to form the rhombic dodecahedron or the multiple rhombic dodecahedron. The unit element of the present disclosure is different from the unit element of a conventional puzzle.

2. The six-rhombic dodecahedron puzzle of the present disclosure utilizes plural unit elements having the concave bodies to form the 11 types of the wooden puzzles, and the wooden puzzles having 18 pieces with 11 types can be arranged in the six-rhombic dodecahedron puzzles having 38 types, so that there are various types which can be constructed by a player. In the present disclosure, the specific number of the wooden puzzles can be selected to join to each other and arrange in the rhombic dodecahedron puzzle, the two-rhombic dodecahedron puzzle, the three-rhombic dodecahedron puzzle, the four-rhombic dodecahedron puzzle or the five-rhombic dodecahedron puzzle. If the player wants to arrange the wooden puzzles in the six-rhombic dodecahedron puzzles, there is no separated rhombic dodecahedron in the six-rhombic dodecahedron puzzles. In addition, the rhombic dodecahedron puzzle and the multiple rhombic dodecahedron puzzle of the present disclosure are appropriate for all ages and can cultivate the abilities of spatial rotation and mental rotation. As compared to conventional puzzles, the unique shapes of the present disclosure increase challenge and enhance the problem-solving strategies in geometry. Moreover, the present disclosure provides a very enjoyable and educational experience.

3. In the present disclosure, there is no pattern on any surface of the wooden puzzles. A joining method of the present disclosure is based on the completion of forming the six-rhombic dodecahedron puzzle without pattern matching so as to enhance the problem-solving strategies in geometry.

4. The rhombic dodecahedron puzzle or the multiple rhombic dodecahedron puzzle of the present disclosure utilizes the base engaged with the base wall to carry and support the wooden puzzles, thereby stably positioning the rhombic dodecahedron or the multiple rhombic dodecahedron.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rhombic dodecahedron puzzle, comprising:

a plurality of wooden puzzles arranged in a rhombic dodecahedron, and each of the wooden puzzles comprising:

two unit elements connected to each other and being the same as each other, wherein each of the two unit elements has a plurality of surfaces, each of the surfaces has a diamond shape or a triangular shape, two of the surfaces having the triangular shape are connected to each other to form a concave shape;

wherein the surfaces comprise a first surface, a second surface, a third surface, a fourth surface, a fifth surface, a sixth surface and a seventh surface, the first surface, the second surface and the third surface are connected to each other, the fourth surface and the fifth surface are connected to each other to form the concave shape, the fourth surface and the fifth surface are connected to the first surface and the second surface, respectively, the sixth surface is connected to the first surface, the third surface and the fourth surface, and the seventh surface is connected to the second surface, the third surface and the fifth surface;

wherein each of the first surface, the second surface and the third surface has the diamond shape, each of the fourth surface, the fifth surface, the sixth surface and the seventh surface has the triangular shape, each of the two unit elements has a first vertex, a second vertex, a third vertex, a fourth vertex, a fifth vertex, a sixth vertex and a central vertex, and the central vertex is a central point of the rhombic dodecahedron;

wherein three-dimensional coordinates of the central vertex, the first vertex, the second vertex, the third vertex, the fourth vertex, the fifth vertex and the sixth vertex are (0, 0, 0), (0, 0, 2), (1, 1, 1), (1, −1, 1), (2, 0, 0), (−1, 1, 1) and (0, 2, 0), respectively;

wherein each of the wooden puzzles is one of a first wooden puzzle, a second wooden puzzle, a third wooden puzzle, a fourth wooden puzzle, a fifth wooden puzzle, a sixth wooden puzzle, a seventh wooden puzzle, an eighth wooden puzzle, a ninth wooden puzzle, a tenth wooden puzzle and an eleventh wooden puzzle, and the first wooden puzzle is in mirror symmetry with respect to the second wooden puzzle, and the third wooden puzzle is in mirror symmetry with respect to the fourth wooden puzzle, and the fifth wooden puzzle, the sixth wooden puzzle and the seventh wooden puzzle are the same as themselves after mirroring, and the eighth wooden puzzle is in mirror symmetry with respect to the ninth wooden puzzle, and the tenth wooden puzzle is in mirror symmetry with respect to the eleventh wooden puzzle.

2. The rhombic dodecahedron puzzle of claim 1, wherein the first vertex, the second vertex, the third vertex and the fourth vertex are corresponding to the first surface;

wherein the first vertex, the second vertex, the fifth vertex and the sixth vertex are corresponding to the second surface;

wherein the first vertex, the third vertex, the fifth vertex and the central vertex are corresponding to the third surface;

wherein the second vertex, the fourth vertex and the central vertex are corresponding to the fourth surface;

wherein the second vertex, the sixth vertex and the central vertex are corresponding to the fifth surface;

wherein the third vertex, the fourth vertex and the central vertex are corresponding to the sixth surface;

wherein the fifth vertex, the sixth vertex and the central vertex are corresponding to the seventh surface.

3. The rhombic dodecahedron puzzle of claim 1, wherein a volume of each of the two unit elements is equal to one-sixth of a volume of the rhombic dodecahedron.

4. The rhombic dodecahedron puzzle of claim 1, wherein each of the first surfaces has a first surface area, each of the second surfaces has a second surface area, each of the third surfaces has a third surface area, each of the fourth surfaces has a fourth surface area, each of the fifth surfaces has a fifth surface area, each of the sixth surfaces has a sixth surface area, and each of the seventh surfaces has a seventh surface area;

wherein each of the fourth surface area, the fifth surface area, the sixth surface area and the seventh surface area is one-haft of the first surface area, and the first surface area, the second surface area and the third surface area are equal to each other.

5. The rhombic dodecahedron puzzle of claim 1, wherein a number of the wooden puzzles is three.

6. The rhombic dodecahedron puzzle of claim 1, further comprising:

at least one base comprising a first convex portion and a first concave portion, wherein the at least one base is configured to carry the wooden puzzles; and at least one base wall detachably connected to the at least one base and comprising a second convex portion and a second concave portion, wherein the second convex portion is correspondingly engaged with the first concave portion, and the first convex portion is correspondingly engaged with the second concave portion.

* * * * *